US006019529A

United States Patent [19]

Yamamoto et al.

[11] Patent Number: 6,019,529

[45] Date of Patent: Feb. 1, 2000

[54] INK FILM CASSETTE AND REEL

[75] Inventors: Junichi Yamamoto, Toyokawa; Atsuhiko Shimoyama, Toyohashi, both of Japan

[73] Assignee: Minolta Co., Ltd., Osaka, Japan

[21] Appl. No.: 08/740,327

[22] Filed: Oct. 28, 1996

[30] Foreign Application Priority Data

Oct. 30, 1995 [JP] Japan ..... 7-281995
Mar. 29, 1996 [JP] Japan ..... 8-075810

[51] Int. Cl.[7] ..... B41J 33/52

[52] U.S. Cl. ..... 400/231; 400/234

[58] Field of Search ..... 400/207, 208, 400/231, 234, 246

[56] References Cited

U.S. PATENT DOCUMENTS

| | | | |
|---|---|---|---|
| 2,137,366 | 8/1938 | Hill et al. | 366/47 |
| 4,660,053 | 4/1987 | Tsutsumi et al. . | |
| 4,978,240 | 12/1990 | Katsuno | 40/246 |
| 5,531,527 | 7/1996 | Maekawa et al. | 400/231 |
| 5,547,183 | 8/1996 | Tamura | 400/231 |
| 5,622,440 | 4/1997 | Yamamoto et al. | 400/234 |

FOREIGN PATENT DOCUMENTS

| | | |
|---|---|---|
| 60-174676 | 9/1985 | Japan . |
| 61-197267 | 9/1986 | Japan . |
| 63-221076 | 9/1988 | Japan . |

*Primary Examiner*—John Hilten
*Attorney, Agent, or Firm*—Burns, Doane, Swecker & Mathis, LLP

[57] ABSTRACT

An ink film cassette 33 incorporates therein a supply reel 30 having an ink film wound thereon and a rewind reel 31 for taking up the ink film 32 and is attached detachably to a thermal transfer printer 10. In the cassette 33, a first torque limiter 85 for transmitting braking force to a supporting shaft 78*a* of the supply reel 30 inside the cassette 33 is fixed detachably to the supporting shaft 78*a*. Bearings 81*a* and 81*b* on the take-upside transmit braking force to supporting shafts 80*a* and 80*b* of the rewind reel 31 inside the ink film cassette. Further in the cassette 33, a second torque limiter 97 for limiting the driving torque of the rewind reel 31 in the ink film cassette is fixed detachably to the supporting shaft 81*a*. A kick spring 106 for causing the ink film paid off the supply reel 30 to be rewound on the supply reel 30 is also fixed detachably to the supply reel 30 in the cassette 33. A torque limiter 200A includes a grease receiver 211 having an opening 211*a* which confronts a boundary 208 between an inner shaft 203 and a housing 202. A stopper 241 for retaining the leading end of the inner shaft 203 in the axial direction is provided in the housing 202 of a torque limiter 200G.

36 Claims, 21 Drawing Sheets

INK FILM CASSETTE AND REEL

BACKGROUND OF THE INVENTION

1. Field of the Invention

This invention relates to an ink film cassette holding an ink film, and a reel to be used for thermal transfer recording device.

2. Description of the Related Art

The thermal transfer printer is provided with a platen roller and a thermal head freely pressed against and separated from the platen roller, and conveys a recording paper through the contacting surface between the platen roller and the thermal head. An ink film which has an ink with thermally fusible or sublimating properties applied to one surface is conveyed into the contacting surface between the recording paper and the thermal head. This ink film is unwound from a reel on the supply side and rewound on a reel on the take-up side. When a color image is reproduced by one thermal head on the recording paper, the printer uses the ink film which has the inks in the colors of yellow, magenta, and cyan applied sequentially in the order on the surface of a thin film base.

In recent years, the thermal transfer printer is applied to an ink film cassette which holds a supply reel and a rewind reel inside and is freely attached to and detached from the main body for improving the efficiency of the setting work of the ink film. The ink film cassette is a consumable product and is replaced with a new supply after the ink film held therein has been used up.

The ink film, during the printing process, is drawn out of the supply reel and is then conveyed in conjunction with the motion of the recording paper by friction force between ink film and the recording paper being conveyed between the platen roller and the thermal head now in a state of being pressed against the platen roller. The ink film paid out of the supply reel is rewound on the rewind reel by the fact that a motor installed in the main body of the thermal transfer printer transmits a rotation to the rewind reel.

The thermal transfer printer is provided in the main body with a supply side torque limiter which is joined to the supply reel and enabled to exert a braking force on the supply reel after the ink film cassette has been set in place. This supply side torque limiter effects continued exertion of a braking force on the supply reel while the ink film is being paid out of the supply reel. As a consequence, the limiter fulfills the purpose of transmitting due tension to the ink film and preventing the ink film from forming wrinkles during the printing process.

Further, inside the main body of the thermal transfer printer, a take-up side torque limiter for limiting driving torque of the rewind reel is disposed between the rewind reel and the motor. This take-up side torque limiter is provided for the following reason besides the reason of transmitting due tension to the ink film during the printing process. The speed of motion of the recording paper and the speed of motion of the ink film must be equalized in the printing unit. Even when the supporting shaft of the rewind reel is rotated at a fixed speed, the speed of rewinding the ink film on the rewind reel is inevitably varied as the roll diameter of the ink film taken up in the rewind reel varies. It is, therefore, provided with the take-up side torque limiter for enabling the speed of rewinding to follow the speed of motion of the ink film in the printing unit and allowing the ink film to be rewound without slacking on the rewind reel.

The torque limiters of the kind that harness the phenomenon of friction have been finding extensive utility to date.

The friction type torque limiter is provided with an inner shaft rotatably supported inside a housing, and a friction member held inside the housing to be pressed against the inner shaft. The friction member is to be pressed against the inner shaft and, in consequence of the resultant friction, is enabled to confer a rotational load on the inner shaft and generate a set torque. Grease is applied between the inner shaft and the friction member.

The prior technique incurs the following problems.

In the conventional ink film cassette, the supply reel and the rewind reel are held inside the ink film cassette so as to be smoothly rotated. Namely, the conventional ink film cassette is designed to reduce the slide resistance generated between the supporting shaft of the supply reel and the ink film cassette retaining the supporting shaft, and the slide resistance generated between the supporting shaft of the rewind reel and the ink film cassette retaining the supporting shaft.

No rotational load is transmitted to the supply reel inside the ink film cassette. When the ink film cassette as a consumable product is shipped and is in the process of transportation, therefore, the ink film is loosed under the influence of an external force and paid out readily from the supply reel. As a result, part of the unused ink film is wrinkled and the ink film cassette can no longer be sold.

In some of the various forms of use found for the ink film cassette, an ink film cassette may be possibly removed from the main body of the printer before the ink film held therein has been completely used up, and the partly used ink film cassette may be again set in place in the main body of the printer. When the ink film cassette is removed in a partly used state as described above, the possibility likewise arises that the ink film held therein will be loosed under the influence of an external force and paid out readily from the supply reel and thus the ink film cassette can no longer be sold.

No rotational load is transmitted to the rewind reel inside the ink film cassette. In consequence, when the ink film cassette is removed in a wholly consumed state from the main body of the printer, there ensues under the influence of an external force the possibility that the ink film which is used up and rewound on the rewind reel will be loosed paid out readily from the rewind reel, and suffered to sustain damage.

When the ink film cassette with the loosed ink film is loaded in the main body of the printer, it calls for an extra work of causing the loosed part of the ink film to be rewound on the supply reel or on the rewind reel and entails the problem of complicating the work of loading.

For the purpose of preventing the unused ink film from being paid out of the supply reel or the used ink film from being paid out of the rewind reel, stoppers for inhibiting the supply reel and the rewind reel from rotating must be fixed one each to the supporting shafts of these reels. This fixation of the stoppers turns out to be a very complicated work.

Further, the supply side torque limiter and the take-up side torque limiter are disposed in the main body of the thermal transfer printer. The fact adds to the complexity of the construction of the printer proper and to the cost of the printer proper and, at the same time, prevents the printer proper from being miniaturized.

Since the torque limiters to be disposed inside the main body of the printer are required to possess as high durability as the other components which are provided inside the main body of the printer, specifically the durability that allows normal formation of 60,000 image planes, they must be made of a relatively expensive material which results in increasing the cost of components and the whole cost of the thermal transfer printer.

The ink film is known in numerous kinds which differ in physical properties of film due to differences such as in section thickness of film and friction coefficient of backcoat. In the thermal transfer printer of the construction which has torque limiters disposed on the main body of the printer as described above, it is not easy to alter the set torque. The thermal transfer printer, therefore, must use an ink film cassette of exclusive design and entails the problem of permitting no addition to the kind of film fit for use.

The ink film cassette is also required to offer service of exalted convenience such as by enabling the user to refill it easily.

On the other hand, the torque limiter itself incurs the following problem.

The conventional friction type torque limiter suffers leakage of grease through the boundary between the housing and the inner shaft with an increase in the total number of rotations. When the torque limiter happens to be used where it is exposed to the user's hand, it is at a disadvantage in smearing the users hand with the leaked grease. It possibly entails the disadvantage that the leaked grease will adhere to and smear other components. When the leakage of grease proceeds excessively, there ensues the disadvantage that the friction resistance between the inner shaft and the friction member will grow possibly to the extent of preventing the torque limiter from exactly responding to the set torque.

The conventional friction type torque limiter is not so constructed as to rely on the housing to arrest the inner shaft in the axial direction. In contrast, the position of the inner shaft in the axial direction is solely retained by the intimate contact with the friction member. Particularly when the torque limiter is such that the friction member produces small pressing force and the set torque is small, therefore, there arises the disadvantage that the inner shaft will be pressed down even by feeble force and will be deprived of usefulness.

SUMMARY OF THE INVENTION

An object of this invention is to provide an improved ink film cassette liberated from the various problems and an improved reel to be appropriately used in the ink film cassette.

Another object of this invention is to provide an ink film cassette which is capable of preventing an unused ink film from being paid out accidentally from a supply reel when the ink film cassette is during the transportation or when the ink film cassette is removed from a thermal transfer printer before the ink film held therein has not been consumed perfectly.

Still another object of this invention is to provide an ink film cassette which is capable of preventing the used part of an ink film from being paid out accidentally from a rewind reel when the ink film cassette is removed from a thermal transfer printer before the ink film held therein has not been consumed perfectly.

Yet another object of this invention is to provide an ink film cassette which fulfills simplification of the main body of the printer and reduction in the cost of the printer proper, increases the variety of ink films to be effectively used, and facilitates the user's work of refilling.

A still further object of this invention is to provide a torque limiter which is appropriately used in the ink film cassette without suffering either leakage of grease or depression of an inner shaft.

This invention provides an ink film cassette which is loaded detachably in the main body of a thermal transfer printer and is enabled, as when the ink film cassette in process of use happens to be removed from the thermal transfer printer, to prevent the unused part of the ink film from being accidentally paid out of the supply reel.

This ink film cassette is to be loaded detachably in a thermal transfer printer, which ink film cassette comprises:

a supply reel having an ink film wound thereon;

a rewind reel for taking up the ink film fed out of the supply reel;

a frame for receiving the supply reel and the rewind reel; and braking means disposed detachably between the supply reel and the frame for applying friction torque to the supply reel.

In this ink film cassette, since the braking means continues to exert friction torque on the supply reel inside the ink film cassette, the ink film will not be directly paid out of the supply reel under external force and the unused ink film will not be wasted even when the ink film cassette is during the transportation or when the ink film cassette is removed from the thermal transfer printer before the ink film held therein has not been consumed perfectly. Since the friction torque is exerted on the supply reel inside the ink film cassette, the need for providing a supply side torque limiter inside the printer no longer exists. The fact makes it possible to simplify the construction of the printer and lower the cost of production and miniaturize the printer proper. The durability of the braking means is only required to be such that the braking means will continue to operate normally until the ink film held therein is wholly consumed. The braking means, therefore, can be formed inexpensively as compared with the supply side torque limiter which is provided inside the printer, with the result that the cost of components will be lowered and the overall cost of the printer proper will be proportionately lowered. Since the braking means is fixed detachably to the supply reel, the friction torque exerted on the supply reel on the side of the ink film cassette can be altered to an appropriate value by selecting the kind of the braking means to suit the kind of film. In consequence, the thermal transfer printer can use the variety of kinds of ink films to be effectively used. Since the braking means can be freely attached to and detached from the supply reel, not only the worker at the factory assembling the ink film cassette but also the user can effect the attachment and the detachment of the braking means or refill the ink film cassette with new supply of ink film.

In this invention, the ink film cassette further comprises second braking means disposed detachably between the rewind reel and the frame for applying friction torque to the rewind reel.

In this construction, since the second braking means continues to exert friction torque on the unwinding reel inside the ink film cassette, the used part of the ink film will not be directly paid out of the rewind reel under an external force and the ink film will not sustain damage even when the ink fill cassette happens to be removed from the thermal transfer printer before the ink film held therein has not bee completely consumed. Further, since the second braking means is fixed detachably to the rewind reel, the friction torque exerted on the rewind reel on the side of the ink film cassette can be altered to an appropriate value by selecting the kind of the second braking means to suit the kind of film.

Consequently, the thermal transfer printer can use the variety of kinds of ink films to be effectively used. Since the second braking means can be freely attached to and detached from the rewind reel, not only the worker at the factory assembling the ink film cassette but also the user can effect the attachment and the detachment of the second braking means or refill the ink film cassette with new supply of ink film.

The ink film cassette further comprises torque limiting means detachably attached in the rewind reel for transmitting to the rewind reel driving force generated by a driving section provided in the thermal transfer printer and limiting the driving torque of the rewind reel.

In this construction, the need for providing a take-up side torque limiter inside the thermal transfer printer no longer exists since the torque limiting means limits the driving torque of the rewind reel inside the ink film cassette. The fact makes it possible to simplify the construction of the printer proper and lower the cost of production and miniaturize the printer proper. The durability of the torque limiting means is only required to be such that the torque limiting means will continue to operate normally until the ink film held there in is wholly consumed. The torque limit means, therefore, can be formed inexpensively as compared with the take-up side torque limiter which is provided inside the printer. And the cost of components will be lowered and the overall cost of the printer proper will be proportionately lowered. Since the torque limiting means is fixed detachably to the rewind reel, the driving torque exerted on the rewind reel on the side of the ink film cassette can be altered to an appropriate value by selecting the kind of the torque limiting means to suit the kind of film. As a consequence, the thermal transfer printer can use the variety of kinds of ink films to be effectively used. Since the torque limiting means can be freely attached to and detached from the rewind reel, not only the worker at the factory manufacturing the ink film cassette but also the user can effect the attachment and the detachment of the torque limiting means or can refill the ink film cassette with new supply of ink film.

The frame of the ink film cassette is provided with a rewind reel holder and a supply reel holder and the rewind reel holder has a larger outside diameter than the supply reel holder. Owing to this differentiation in shape, the loading direction can be easily discerned during the loading of the ink film cassette inside the thermal transfer printer. The ink film cassette in this shape is easily taken by the user and does not allow easy access to the ink film when it is held in the user's hand. And the user can safely cope with the increase of the roll diameter after printing. Further, the frame is formed of an upper frame and a lower frame which are divisible in the vertical direction.

The braking means disposed between the supply reel and the frame and torque limiting means attached in the rewind reel are respectively composed of the torque limiters which are made of a same material. In this case, both torque limiters manifest the same behavior even when the service temperature of the ink film cassette happens to vary. Therefore, it can be easily accomplished to retain the difference in torque between the supply side and the take-up side. Furthermore, the each torque limiter is fixed as nipped between the upper and lower frames, and is capable of adjusting torque. On the other hand, the second braking means is ccmposed of bearings which rotatably support the rewind reel.

The supply reel for use in a thermal transfer printer comprises a shaft having an ink film wound thereon and a torque limiter provided on the shaft for preventing the shaft from freely rotating while the supply reel is in use. On the other hand, the rewind reel for use in a thermal transfer printer comprises a shaft for taking up an ink film and a torque limiter provided on the shaft for transmitting to the shaft the driving force generated by a driving section provided in the thermal transfer printer and limiting the driving torque of the shaft.

In this invention, the torque limiter provided for the reel of the ink film cassette comprises a housing, an inner shaft rotatably supported in the housing, pressing means held in the housing, pressed against the inner shaft, and enabled to exert a rotational load on the inner shaft, grease applied between the inner shaft and the pressing means, and a grease receiver disposed on the inner shaft and/or in the housing in such a manner that the opening thereof confronts the boundary between the inner shaft and the housing.

This torque limiter obtains a set torque by the fact that the pressing means exerts the rotational load on the inner shaft. The grease applied between the pressing means and the inner shaft has a tendency to leak through the boundary between the housing and the inner shaft with the increase in the total number of rotations. Since the grease receiver disposed on the inner shaft and/or in the housing has the opening halfway along the length of the boundary destined to serve as the path for the leakage of the grease, the grease receiver collects the grease verging on leakage to the exterior through the opening. There is no possibility of the grease going beyond the grease receiver and smearing the exterior. The disadvantage due to insufficient supply of grease will not occur because the grease receiver is ready to dispense grease when the supply of grease between the inner shaft and the pressing means tends to shortage.

In still this invention, the torque limiter provided for the reel of the ink film cassette comprises a housing, an inner shaft rotatably supported in the housing, pressing means held in the housing, pressed against the inner shaft, and enabled to exert a rotational load on the inner shaft, and a stopper disposed in the housing for arresting the leading end of the inner shaft toward the axial direction.

In this torque limiter, when any pressing force surpassing the rotational load by the pressing means on the inner shaft happens to act on the inner shaft and depress the inner shaft toward the side of the leading end, the inner shaft is prevented from continuing its motion after the leading end has collided against the stopper disposed in the housing. Even in the torque limiter having only small set torque, there is no possibility that the inner shaft will be excessively depressed and deprived of usefulness.

BRIEF DESCRIPTION OF THE DRAWINGS

FIG. 4A depicting the state during the supply of paper, FIG. 4B the state at the start of printing, FIG. 4C the state at the end of printing, FIG. 5A the state at cutting the leading end of paper, and FIG. 5B the state at cutting the trailing end of paper.

DETAILED DESCRIPTION OF THE PREFERRED EMBODIMENT

Now, a thermal transfer printer according to an embodiment of this invention will be described below with reference to drawings.

First Embodiment (Construction of thermal transfer printer)

Figure 1:
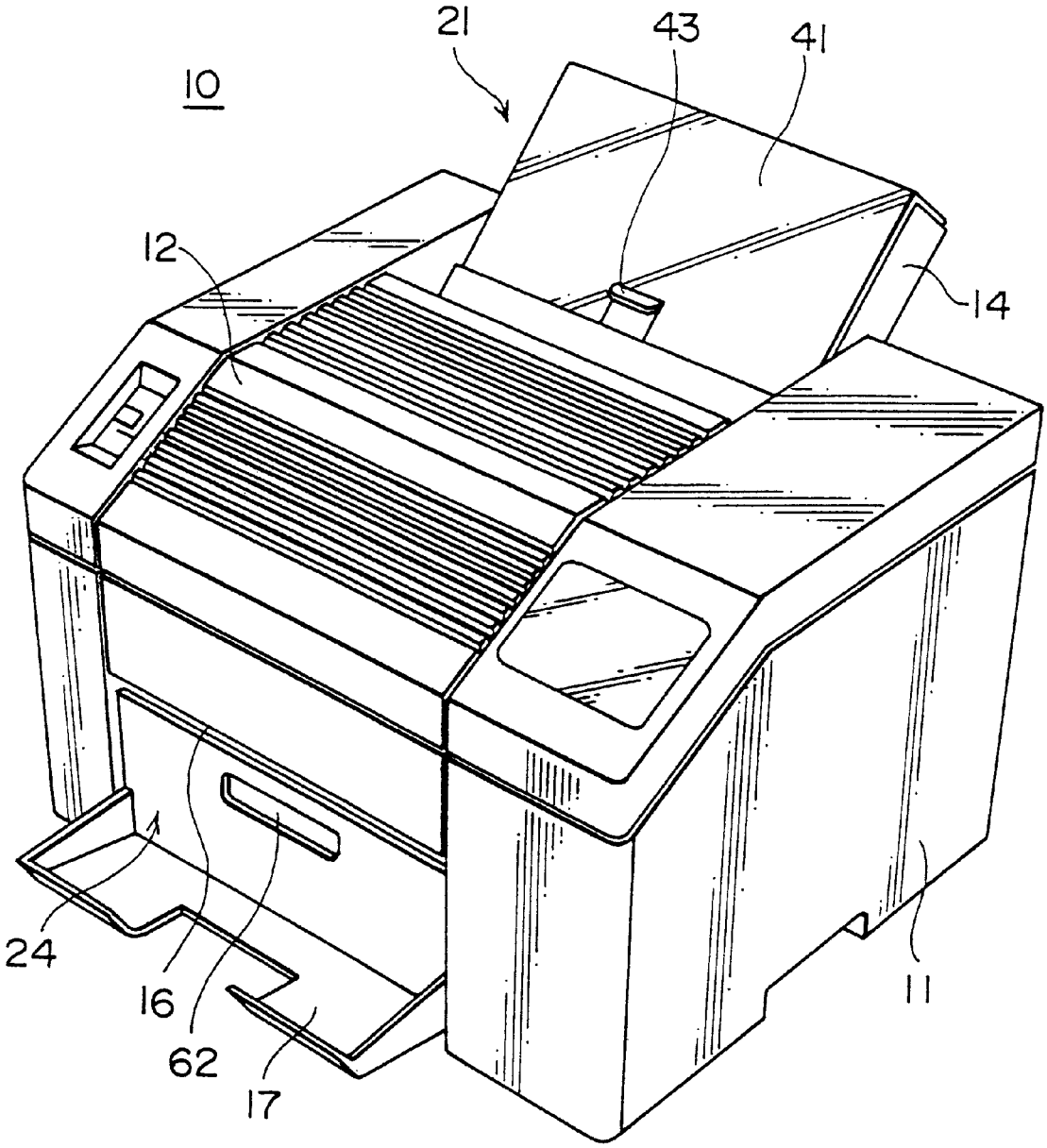
FIG. 1 is a perspective view illustrating the appearance of a thermal transfer printer in which an ink film cassette according to an embodiment of this invention is detachably loaded.

FIG. 1 is a perspective view illustrating the appearance of a thermal transfer printer in which an ink film cassette according to one embodiment of this invention is detachably loaded.

For the sake of convenience of the description, the edge of a recording paper which forms the side of the leading end at being discharged from the printer will be referred to as the "leading end of the recording paper".

A thermal transfer printer 10 illustrated in the diagram is used at, for example, a processing station for printing photographs for producing a so-called index print, i.e. the reproduction on one recording paper of such information as is originally recorded in a plurality of frames on a negative film. To the printer 10, a control device (not shown) for performing various image processing operations on the information recorded on the negative film is connected through an interface, and the image signals and the control signals from the control device are inputted through the interface.

Figure 2:
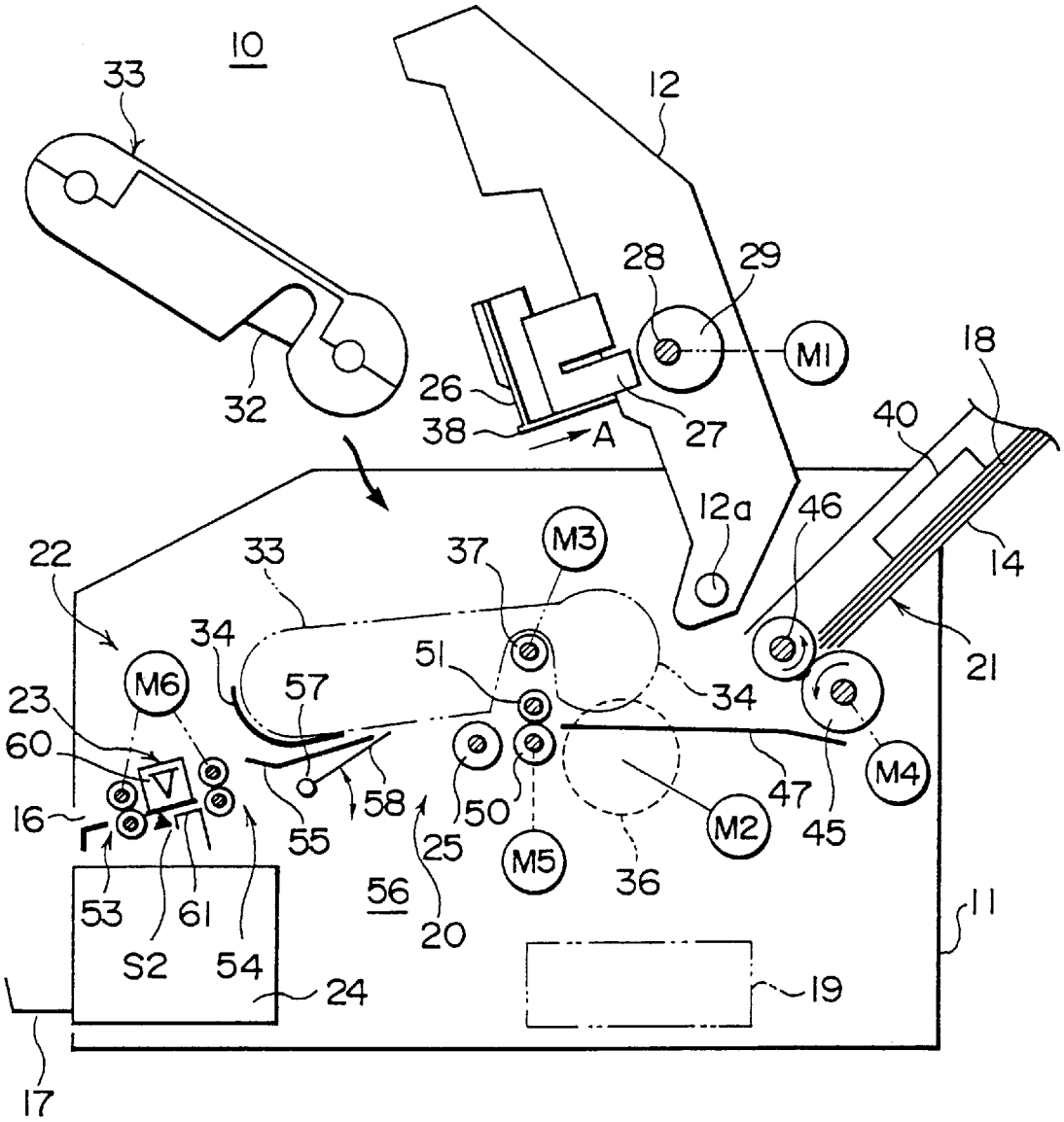
FIG. 2 is a schematic cross section illustrating the inner construction of the thermal transfer printer with a lid posed in an opened state.

To the upper surface of a housing 11 which constitutes the main body of the printer 10, a lid 12 is attached so as to be opened and closed freely around a rocking shaft 12*a* (FIG. 2). With the lid 12 in an opened state, an ink film cassette is set at a prescribed position in the housing 11. The left foreground side in the diagram forms the front surface of the printer 10. A paper discharging unit is provided on the front surface side and a paper feeding unit 21 is provided on the rear surface side. In the paper feeding unit 21, a paper feeding tray 14 holding a plurality of recording papers is disposed aslant. The printer 10 is further provided therein with a paper cutting unit which, as will be specifically described herein below, cuts off such unnecessary parts of a recording paper on which an image has been reproduced, namely the leading end part and/or the trailing end part. A duster 24 for storing the cut-off of paper is set in place extractably on the front surface side of the printer. The recording paper which remains after the separation of the unwanted parts is passed through a paper discharge port 16 and discharged in the longitudinal direction into a paper discharge tray 17 integrally formed on the front surface of the duster 24. Since the recording paper is discharged in the longitudinal direction as described above, the size of the paper discharge tray 17 which protrudes from the front surface of the housing 11 is relatively small. The paper feeding tray 14 is disposed aslant. Since the entire space required for the installation of the thermal transfer printer, therefore, is small, this printer fits installation at a place which offers only a cramped working space.

The printer 10 of the present embodiment uses an ink film coated with a thermal subliming ink. As the recording paper for producing an image by trapping the sublimed ink, such paper as the photographic printing paper which shows strong nerve and has a large thickness (150–250 $\mu$m) is used.

Figure 3:
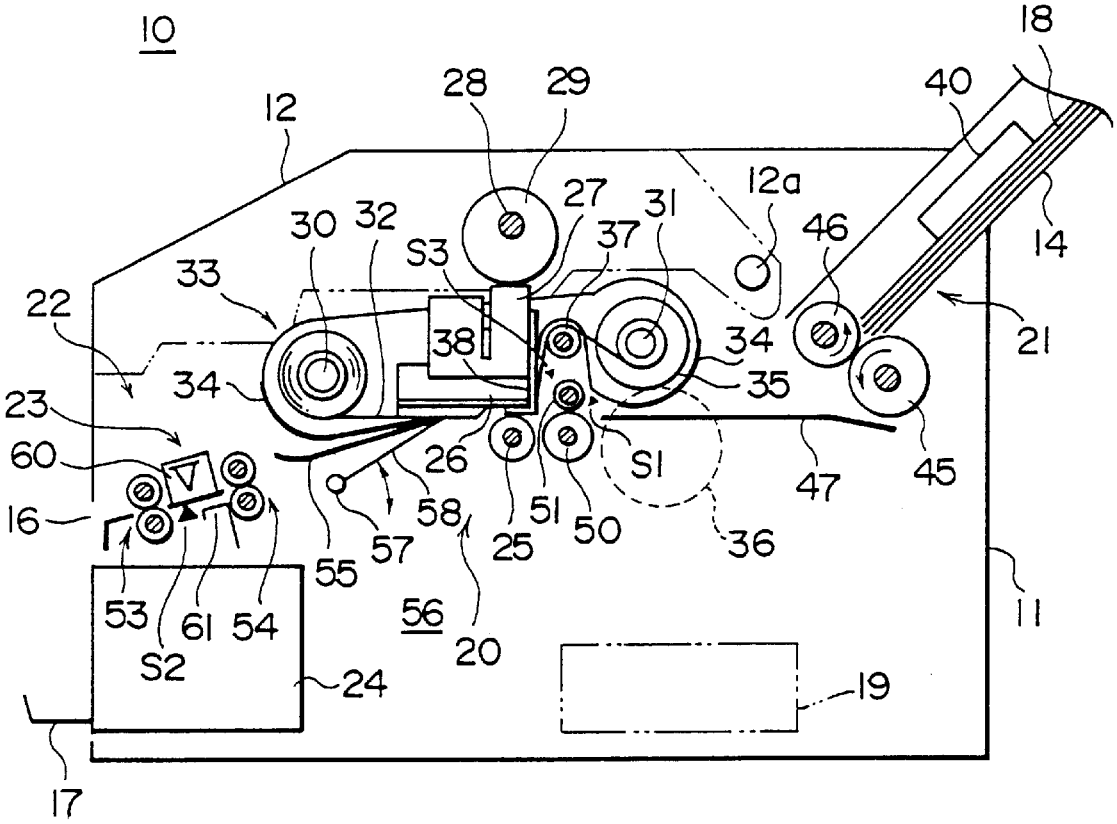
FIG. 3 is a schematic cross section illustrating the inner construction of the thermal transfer printer in a state having the ink film cassette loaded therein.

FIG. 2 is a schematic cross section illustrating the inner construction of the thermal transfer printer with a lid thereof posed in an opened state, FIG. 3 is a schematic cross section illustrating the inner construction of the thermal transfer printer in a state having the ink film cassette loaded therein, and FIG. 4A–FIG. 4C and FIG. 5A and FIG. 5B are cross sections schematically illustrating the states of operation of the thermal transfer printer respectively during the supply of paper, at the start of printing, at the end of printing, at cutting the leading end of paper, and at cutting the trailing end of paper.

First, to outline the inner construction of the printer 10, as illustrated in FIG. 2 and FIG. 3, this printer comprises a printing unit 20 positioned roughly in the central part thereof for conveying a recording paper 18 in a parallel pattern, the paper feeding unit 21 positioned on the rear surface side of the printer and disposed above the printing unit 20 as slanted with an angle of about 45 degrees, and a paper discharging unit 22 opposed to the paper feeding unit 21 across the printing unit 20. The quality of the print on the recording paper 18 of a large thickness and strong nerve is exalted by having the printing unit 20 designed for the parallel conveyance system. By disposing the paper feeding unit 21 aslant, a saving is attained on the floor space required for the installation of the printer as described above. Further, by having the paper discharging unit 22 opposed to the paper feeding unit 21 across the printing unit 20, the printer is enabled to offer the convenience of the sort experienced in the use of a facsimile device and assume the shape with enhanced acceptability for the user. The paper discharging unit 22 is provided with a paper cutting unit 23 which cuts off the unwanted parts of the recording paper 18 on which the image has been reproduced. Below the paper cutting unit 23 is disposed the duster 24. The printer also incorporates therein a control unit 19 which executes prescribed image processing operations in response to the image signal inputted by an external control device and, at the same time, controls the operation of the printer 10.

To describe in detail the inner construction of the printer 10, a platen roller 25 is supported rotatably in the housing 11. To the inner surface side of the lid 12, a head base 27 provided with a thermal head 26 is attached through an interlock member (not shown) so as to be moved toward and away from the platen roller 25. When the head base 27 is advanced toward the platen roller 25, the thermal head 26 is moved until it is pressed against the platen roller 25. When the head base 27 is moved away from the platen roller 25, the thermal head 26 is separated from the platen roller 25. The head base 27 is, by such resilient means as a spring (not shown), urged in the direction indicated by an arrow mark A in FIG. 2 so that the thermal head 26 may be retained at a position away from the platen roller 25 or at a pressure release position.

Figure 4A:
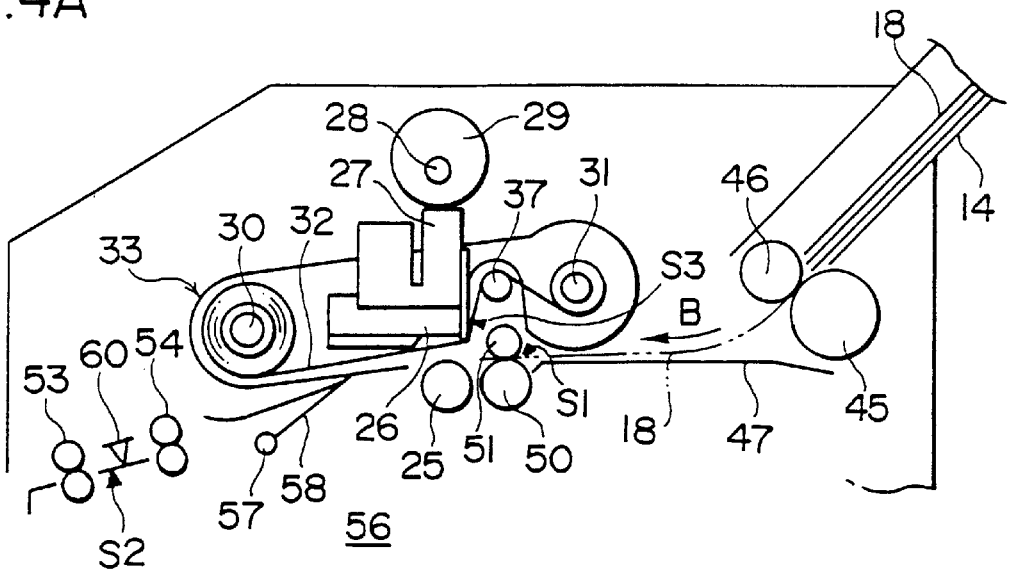
FIGS. 4A, 4B, and 4C and FIGS. 5A and 5B are cross sections schematically illustrating the states of operation of the thermal transfer printer.

An eccentric cam 29 which collides against the head base 27 and moves the head base 27 forward and presses the thermal head 26 against the platen roller 25 is fixed to a drive shaft 28 attached rotatably to the lid 12. A thermal head drive motor M1 formed of a pulse motor for rotating the drive shaft 28 and setting the eccentric cam 29 rotating is connected to the drive shaft 28. When the eccentric cam 29 rotates and the cam center approaches the head base 27 as illustrated in FIG. 3, the head base 27 is advanced and the thermal head 26 is pressed against the platen roller 25. When the eccentric cam 29 rotates and the cam center moves away from the head base 27 as illustrated in FIG. 4A, the head base 27 is moved backward and the thermal head 26 is separated from the platen roller 25 by the resilient force of the spring. The lid 12 is provided with a cooling fan (not shown) and the thermal head 26 is cooled with the wind generated by the cooling fan. When the lid 12 is closed, the lid 12 is fastened to the housing 11 by such engaging means as a pin (not shown).

An ink film 32 in the shape of a ribbon which is to be paid out of a supply reel 30 and taken up on a rewind reel 31, is conveyed between the thermal head 26 and the platen roller 25 as illustrated in FIG. 3. The ink film 32 is formed by applying ink layers of the three colors, yellow, magenta, and cyan to a base film in the order named. The ink film, when necessary, may additionally use a white ink or an overcoating agent. The ink film 32, when not yet used, is wound on the supply reel 30. As the ink film 32 is used, the used part thereof is taken up on the rewind reel 31.

The two reels 30 and 31, respectively on the supply side and the take-up side, are received in an ink film cassette 33. This cassette 33 is detachable relative to the housing 11 and it is mounted at a prescribed position by being set on a retaining plate 34 which is fixed to the interior of the housing 11. Part of a gear 35 fixed on the rewind reel 31 confronts an opening formed in the cassette 33. When the ink film cassette is set in place, a drive gear 36 for rewinding an ink film, which is formed in the main body of the printer is meshed with the gear 35. The drive gear 36 is rotated by a motor M2. The construction of the cassette 33 will be described in detail herein below.

For the purpose of forming a path for the conveyance of the ink film 32, a rewinding roller 37 is rotatably disposed at a position at which the cassette 33 is depressed inwardly when the ink film cassette is mounted. This rewinding roller 37 has the surface formed of a rubbery material with high friction resistance and it is rotated by a rewinding motor M3 formed of a pulse motor. An electromagnetic clutch (not shown) is interposed between the rewinding motor M3 and the rewinding roller 37. The electromagnetic clutch is turned on only when the leading end of the ink film 32 is to be positioned while the printer is not during the printing operation, namely the thermal head 26 is kept apart from the platen roller 25. It is turned off in any other state such as when the printer is at printing.

While the printer executes the printing operation, the thermal head 26 is pressed against the platen roller 25 and the ink film 32, by the friction force with the recording paper 18 conveyed between the platen roller 25 and the thermal head 26, is drawn out of the supply reel 30 and conveyed at the same speed as that of the motion of the recording paper 18. By the fact that the motor M2 rotates the rewind reel 31 through the drive gear 36 and the gear 35, the ink film 32 paid out of the supply reel 30 is guided by a guide plate 38 disposed at the leading end of the thermal head 26 and the rewinding roller 37 and ultimately taken up on the rewind reel 31. During this printing operation, the electromagnetic clutch is turned off and the rewinding roller 37 follows the motion of the ink film 32 and functions as a guide roller for directing the conveyance of the ink film 32.

During the absence of the printing operation, the thermal head 26 is kept apart from the platen roller 25. When the leading end of the ink film 32 is to be positioned in this state, the electromagnetic clutch is turned on and the rewinding roller 37 is rotated by the rewinding motor M3. As a result, the ink film 32 is drawn out of the supply reel 30 and taken up on the rewind reel 31 by the friction force which is generated between the ink film 32 and the rewinding roller 37 to be rotated consequently.

The recording paper 18 is retained in a slanted state on the paper feeding tray 14 as mentioned above. The paper feeding tray 14 is provided with a width regulating plate 40 which regulates the recording paper 18 in the direction of width. This width regulating plate 40 is allowed to slide in the direction of width, depending on the size of the recording paper 18. To the paper feeding tray 14, a cover 41 for preventing dirt from adhering to the recording paper 18 (FIG. 1) is attached so as to be opened and closed around a hinge (not shown). The cover 41 is formed of such a transparent material as acrylic resin in order that the residue of recording paper 18 in the paper feeding tray 14 may be visually discerned from outside. The reference numeral "43" in FIG. 1 denotes a handling member to be used in opening and closing the cover 41.

The stack of recording papers 18 held on the paper feeding tray 14 are fed out one by one by a paper feed roller 45 and a separating roller 46 disposed as opposed to the paper feed roller 45 across a minute gap and then is conveyed as guided by a guide member 47. The paper feed roller 45 is rotated by a paper feeding motor M4 which is formed of a pulse motor.

On the upstream side of the platen roller 25, a grip roller 50 and a pinch roller 51 in contact with the grip roller 50 are disposed adjacently to the platen roller 25. The recording paper 18 fed from the paper feeding tray 14 is advanced into the gap between the two rollers 50 and 51. The grip roller 50 is rotated by a grip roller drive motor M5 which is formed of a pulse motor. The pinch roller 51 is caused to rotate by following the conveyance of the recording paper.

On the downstream side of the platen roller 25, a first paired discharge rollers 53 positioned on the side of the paper discharge port 16 and a second paired discharge rollers 54 positioned on the side of the platen roller 25 are disposed as separated from each other by a prescribed distance in order that the recording paper 18 may be discharged onto the paper discharge tray 17. These paired discharge rollers 53, 54 are rotated by a conveying motor M6 formed of a pulse motor. The second paired discharge rollers 54 is reversibly rotated by a conveying motor M6. A drive gear (not shown) for transmitting the driving force of the conveying motor M6 to the first paired discharge rollers 53, incorporates therein a one-way clutch which allows the first paired discharge rollers 53 exclusively a normal rotation in the direction in which the recording paper 18 is discharged. The first paired discharge rollers 53, therefore, is not suffered to reverse its rotation even when the rotation of the second paired discharge rollers 54 is reversed by reversing the rotation of the conveying motor M6. Further, the operator is allowed to extract the recording paper 18 while the second paired discharge rollers 54 is rotating in the reverse direction.

A guide member 55 for guiding the recording paper 18 in the discharge process is provided between the platen roller 25 and the paired discharge rollers 53, 54. Below the guide member 55 is formed a holding space 56 which is intended to hold the recording papers 18 during the printing operation.

Figure 4B:
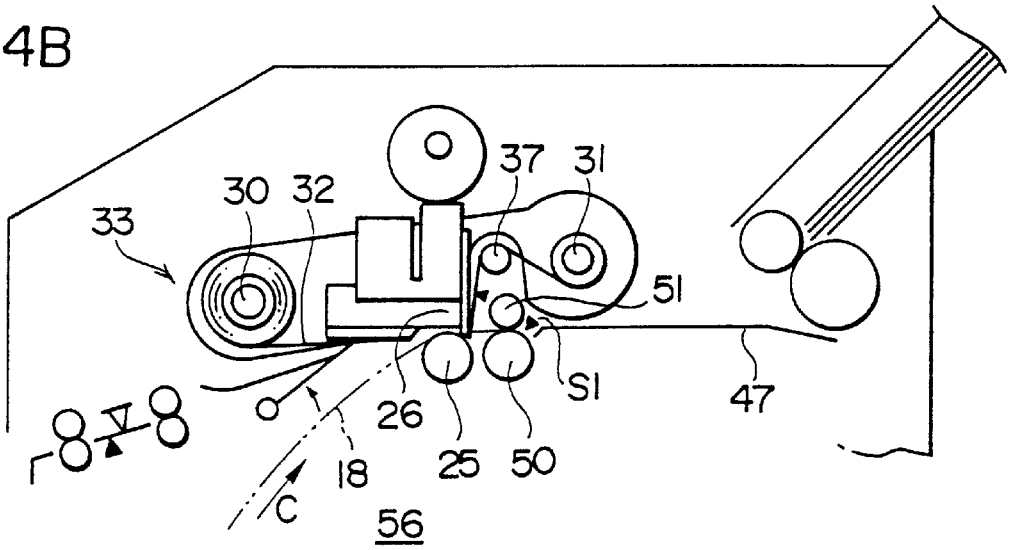

For the reproduction of a color image on the recording paper 18 in the illustrated printer 10, the recording paper 18 is fed out of the paper feeding tray 14 as illustrated in FIG. 4A, advanced in the direction indicated by an arrow mark B, and set in the holding space 56 as illustrated in FIG. 4B. Then, the recording paper 18 is returned from the ensuant state in the direction indicated by an arrow mark C and a yellow image is formed on the recording paper being conveyed. This operation is referred to as a "return printing method". After the yellow image has been transferred to the recording paper 18 in return conveyance, the recording paper 18 is advanced in preparation for the reproduction of the image in the color of magenta. By transferring images with, for example, three colors by the surface sequential method as described above, the color image is formed on the recording paper 18. It is only at the time of return conveyance that the thermal head 26 is pressed against the platen roller 25. The thermal head 26 is separated from the platen roller 25 while the recording paper 18 is in forward conveyance. When the return conveyance and the forward conveyance are repeated for the purpose of printing, the grip roller 50 and the pinch roller 51 continue to keep the recording pacer 18 nipped therebetween.

Figure 5A:
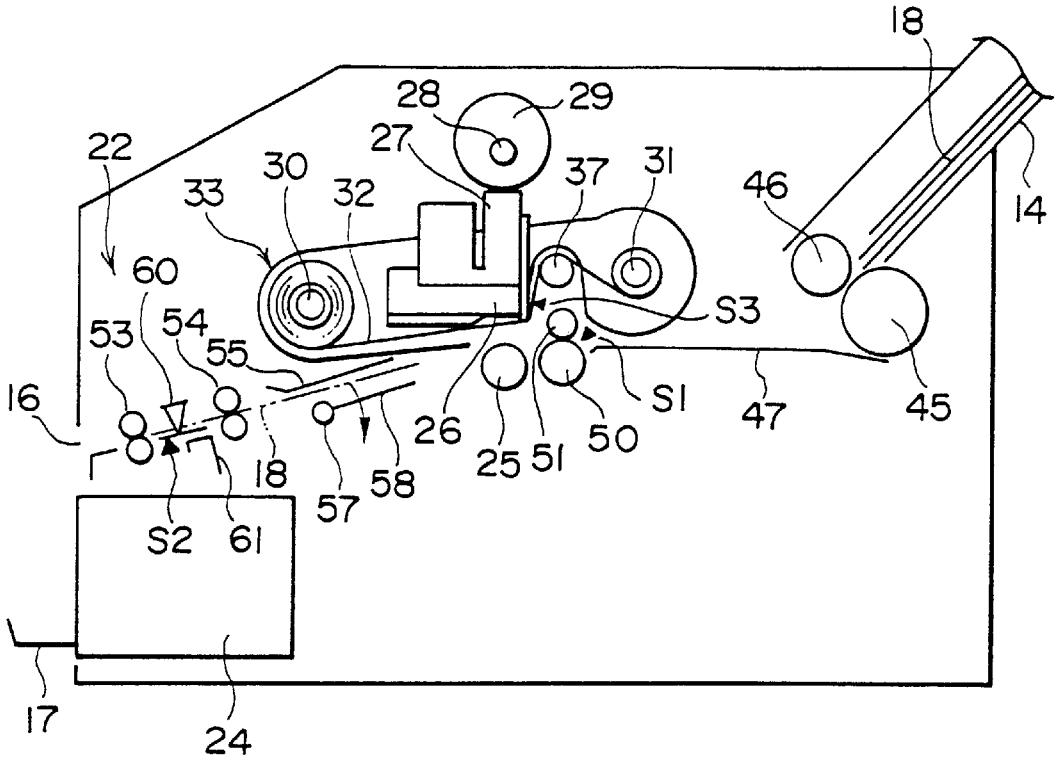

Below the guide member 55, a rocking guide 58 is disposed swingably around a supporting shaft 57 as the center so as to guide the recording paper 18 being conveyed by the grip roller 50 and the pinch roller 51 selectively to either the paper discharging unit 22 with the paired discharge rollers 53, 54 or the holding space 56. The rocking guide 58 is formed of a flexible material. When the rocking guide 58 is swung to an upper position as illustrated in FIG. 4B, the recording paper 18 being conveyed by the grip roller 50, etc. is received into the holding space 56. When the rocking guide 58 is swung clockwise from the upper position to a lower position around the supporting shaft 57 as the center as illustrated in FIG. 5A, the recording paper 18 is conveyed toward the paper discharging unit 22.

For the sake of improving the quality of a print, the recording paper 18 must be prevented from being nipped by the paired discharge rollers 53, 54 during the printing operation. When the rocking guide 58 is provided and the holding space 56 is formed in the lower position of the path for conveyance reaching the paper discharging unit 22 as contemplated by the present embodiment, there is no possibility of the recording paper 18 being nipped between the paired discharge rollers 53, 54 even when the distance between the platen roller 25 and the paired discharge rollers 53, 54 is small and the floor area required for the installation of the printer 10 is decreased.

A cutter unit 23 as the paper cutting unit is interposed between the first paired discharge rollers 53 and the second paired discharge rollers 54. This cutter unit 23 comprises a rotary cutter 60 and a cradle 61 for cooperating with the cutter 60 to cut the recording paper 18. The unwanted parts of the recording paper thus removed by the cutting are allowed to fall under their own weights into the duster 24 disposed below the cutter unit 23. The duster 24 can be drawn in and out of the housing 11. The duster 24 may be opened on the upper side and the amount of recording paper 18 stored therein may be visually discerned from outside of the printer 10 by having at least the front surface formed of such a transparent material as acrylic resin.

The reference numeral "62" used in FIG. 1 denotes an opening formed in the upper part of the front surface of the duster 24 as a handle. The user, with his finger locked in the handle 62, draws the duster 24 from the housing 11 and remove scraps of paper stored in the duster 24.

Figure 6:
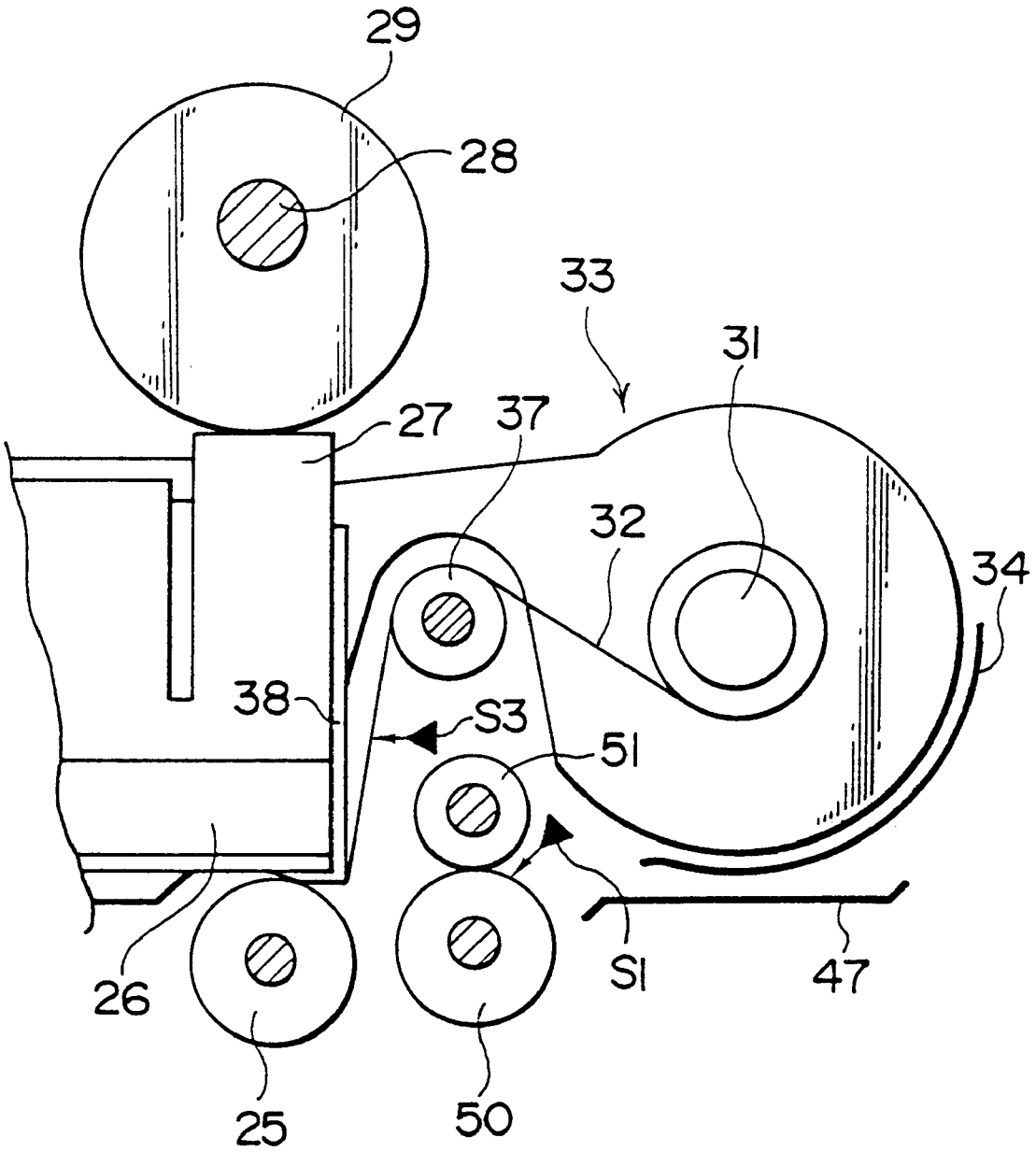
FIG. 6 is a enlarged cross section illustrating the essential part of a printing unit of the thermal transfer printer.

A sensor S1 for detecting the leading end of the recording paper during the supply of paper or the trailing end of the recording paper during the printing operation is disposed adjacently to the grip roller 50 as illustrated in a magnified scale in FIG. 6. The sensor S1 outputs an ON signal when it has detected the leading end or the trailing end of the recording paper 18. Since the sensor S1 detects the trailing end of the recording paper during the printing operation, it will be referred to in the following description as a "trailing end sensor S1" for the sake of convenience.

In the cutter unit 23, a leading end sensor S2 for detecting the leading end of the recording paper is disposed as illustrated in FIG. 2. The leading end sensor S2 outputs an ON signal when it has detected the leading end of the recording paper 18. The pulses for driving the conveying motor M6 are controlled on the basis of the time at which the leading end sensor S2 detects the leading end of the recording paper 18 for the leading end cut as cutting a prescribed length of the recording paper 18 from the leading end, and the trailing end cut as cutting a prescribed length of the recording paper 18 from the trailing end.

A mark sensor S3 for detecting a positioning mark arranged on the ink film 32 is disposed adjacently to the ink film guide roller 37 as illustrated on a magnified scale in FIG. 6. The positioning mark is deposited photographically in the leading end part of the yellow ink layer. The leading end positioning of the ink film 32 is accomplished by turning on the electromagnetic clutch and causing the rewinding motor M3 to rotate the rewinding roller 37 and enabling the ink film 32 to be conveyed with the friction force consequently generated between the ink film 32 and the rewinding roller 37. This leading end positioning is carried out while the recording paper 18 is being conveyed forward until the training end sensor S1 detects the trailing end of the recording paper 18 which has been fed out. The leading end positioning of the ink layer of the subsequent color is accomplished by turning on the electromagnetic clutch, causing the rewinding roller 37 to convey the ink film 32 with the friction between the ink film 32 and the rewinding roller 37, and using an encoder (not shown) disposed at one end of the rewinding roller 31 to measure the amount of conveyance of the ink film 32 in terms of the number of pulses.

As concrete examples of the sensors S1, S2, and S3, reflection type photo-sensors may be cited. These sensors do not need to be limited to the reflection type photo-sensors. Transmission type photo-sensors may be used instead.

(Conveyance of ink film)

Figure 7A:
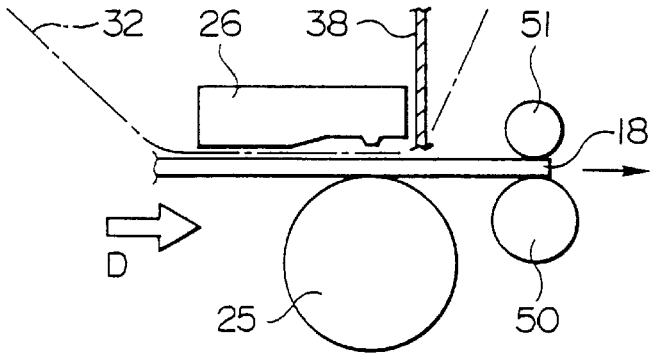
FIG. 7A and FIG. 7B are conceptual diagrams to aid in the description of the conveyance of an ink film in the thermal transfer printer.

Now, the conveyance of the ink film 32 in the thermal transfer printer will be described below with reference to FIG. 7A and FIG. 7B.

The thermal transfer printer accomplishes the printing operation while causing the grip roller 50 and the pinch roller 51 to take hold of the recording paper 18 and draw it in the direction of printing indicated by an arrow mark D. The ink film 32 is meanwhile kept nipped between the recording paper 18 and the thermal head 26. When the recording paper 18 is advanced, the ink film 32 is fed out by the friction to be generated between the ink film 32 and the recording paper 18.

Figure 7B:
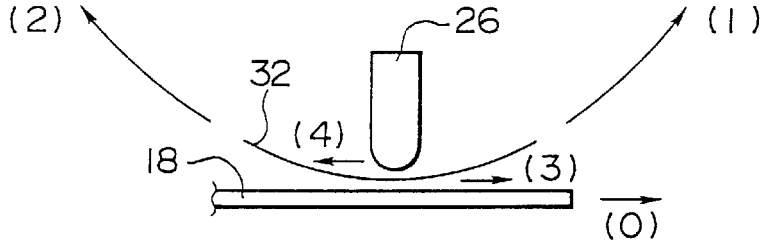

As conceptually illustrated in FIG. 7B, the following forces act on the ink film 32.

(0) The force with which the grip roller 50 draws the paper (gripping force):

(1) The force to rewind the ink film 32 (the torque acting on the rewind reel 31):

(2) The force to wind the ink film 32 backward (the torque acting on the supply reel 30):

(3) The force with which the ink film 32 is forwarded by the recording paper (friction force):

(4) The force to prevent the ink film 32 from being forwarded by the thermal head 26 (friction force):

The fulfillment of the following formula constitutes itself a requirement for effective feeding of the ink film.

$$(1)+(3)>(2)+(4)$$

It is clearly noted from the formula that the ink film 32 will not be fed out if the force (2)+(4) acting on the ink film 32 in the direction opposite the printing direction D is unduly strong. Thus, the ink film 32 is compelled to produce prints in double strokes, adhere to the recording paper 18, and prevent the recording paper 18 from being smoothly paid out.

It is noted that when the friction force of (4) is unduly large, the fulfillment of the formula requires to decrease the force (2) for rewinding the ink film 32. Incidentally, the friction force (3) is minimized in the absence of the printing operation.

For the sake of decreasing the back tension (torque) (2) of the ink film 32, it may be conceived that ample nerve of the ink film 32 is acquired as by increasing the thickness of the basis for the ink film and the friction coefficient of the back coat of the ink film 32 is increased for augmenting the friction force (4). If the friction coefficient of the backcoat is unduly small, the disadvantage arises that the ink film 32 will be drawn or fed out excessively.

As the problems of quality concerning the ink film of the thermal transfer printer, the following adverse phenomena may be cited.

(1) The unevenness of image density in the paper transferring direction owing to the defective feeding of the ink film and the defective separation of the ink film from the recording paper:

(2) The incoincidence of leading end of color images arising from the defective feeding of the ink film:

(3) The paper jam owing to the defective separation of the ink film from the recording paper:

(4) The occurrence of wrinkles in the ink film owing to the slack of the ink film and the wrong feeding of the ink film:

Various devices have been developed for the solution of these problems. The transmission of appropriate torque to the ink film may be cited as one of the effective means. An ink film which is liable to warp must be given due tension. An ink film destined to contact the thermal head fails to advance unless it is given due tensile force. Of course, the ink film must not be stretched to any excess.

The ink films of different kinds vary in such physical properties as section thickness, friction coefficient of back coat, and smoothness even when they are manufactured by one same film producer.

For the purpose of securing smooth conveyance of an ink film by transmitting appropriate torque to the ink film, therefore, it becomes necessary to alter the torque, depending on the friction coefficient of the ink film which varies from one kind to another of the ink film.

The ink film cassette 33 of this embodiment, therefore, is constructed as described in detail below in due respect of the necessity for transmitting appropriate torque to the ink film 32.

(Construction of ink film cassette)

Figure 8:
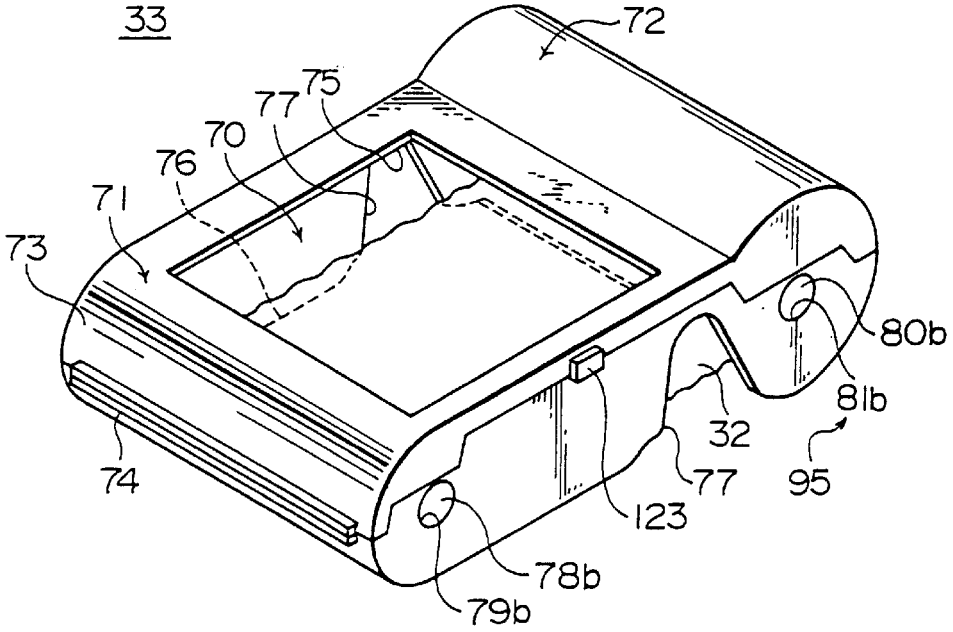
FIG. 8 is a perspective view illustrating the appearance of an ink film cassette according to an embodiment of this invention.

The ink film cassette 33 is provided, as illustrated in FIG. 8, with a film guide 70 disposed at the center thereof and a supply reel holder 71 formed at one end part and a rewind reel holder 72 formed at the other end part respectively of the film guide 70. These parts are assembled by mutually abutting an upper frame 73 and a lower frame 74 which are severally formed of synthetic resin. In the upper and the lower wall of the film guide 70 in the drawing, an upper opening 75 and a lower opening 76 are respectively formed. In the lateral walls of the lower frame 74, notches 77 for receiving the rewinding roller 37 are formed.

Figure 9:
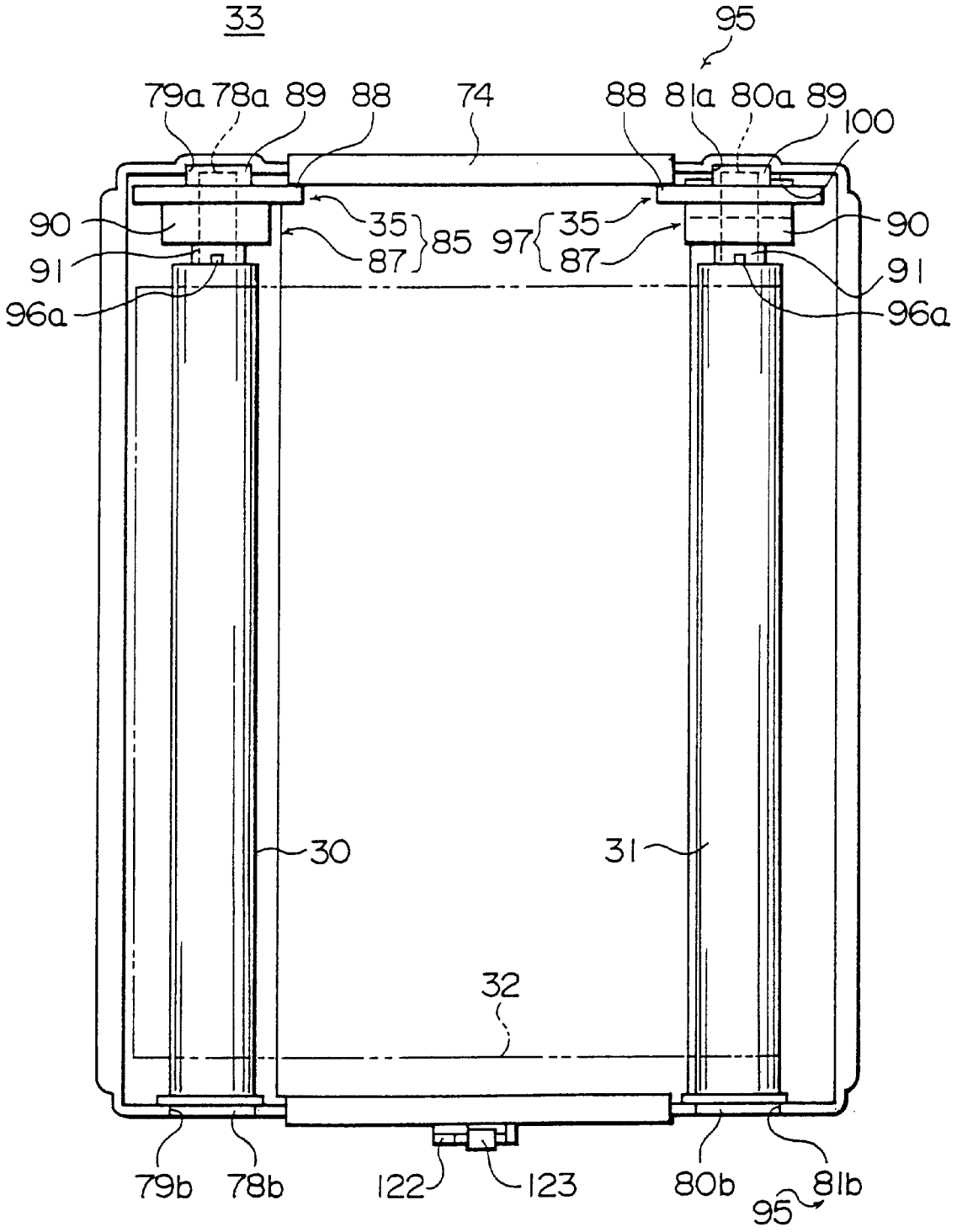
FIG. 9 is a plan view illustrating the state in which relevant reels are attached to a lower frame of the ink film cassette.
Figure 10:
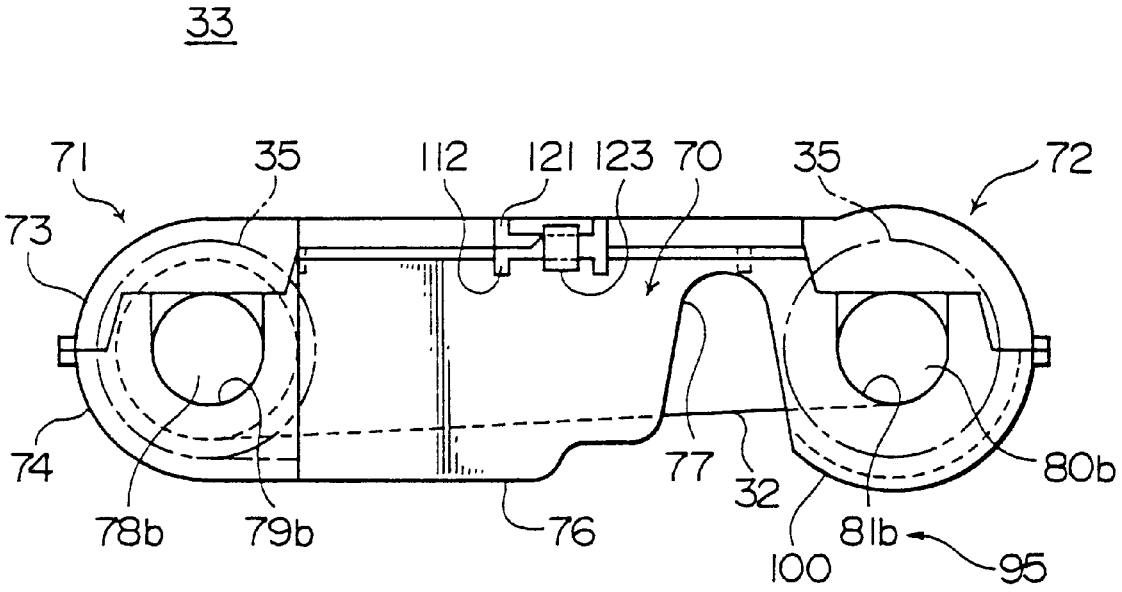
FIG. 10 is a side view illustrating the ink film cassette.

The supply reel holder 71 incorporates therein the supply reel 30 having the ink film 32 wound thereon and the rewind reel holder 72 incorporates therein the rewind reel 31 as illustrated in FIG. 9 and FIG. 10. Of supporting shafts 78*a* and 78*b* disposed at the opposite ends of the supply reel 30, the supporting shaft 78*b* shown on the lower side in FIG. 9 is supported rotatably by a supply side bearing 79*b* formed on the lateral walls of the upper and lower frames 73 and 74. Similarly, of supporting shafts 80*a* and 80*b* disposed at the opposite ends of the rewind reel 31, the supporting shaft 80*b* is supported rotatably by a take-up side bearing 81*b* formed on the lateral walls of the upper and lower frames 73 and 74. The other supporting shafts 78*a* and 80*a* of the reels 30 and 31 are supported rotatably respectively by a first torque limiter 85 and a second torque limiter 97 which will be described specifically herein below.

The rewind reel holder 72 is formed with a larger outside diameter than the supply reel holder 71. Owing to this differentiation in shape, the loading direction can be easily discerned during the loading of the cassette 33 in the main body of the printer. The ink film cassette in this shape is easily taken by the user and does not allow easy access to the ink film 32 when it is held in the user's hand. After the printing, the ink film 32 has formed wrinkles. When the ink film 32 originally wound on the supply reel 30 has been wholly rewound on the rewind reel 31, therefore, the roll diameter of the rewind reel 31 with the ink film 32 is inevitably larger than the initial roll diameter of the supply reel 30 with the ink film 32. The larger outside diameter of the rewind reel holder 72 also allows to accommodate the used ink film 32 wound on the rewind reel 31.

Figure 11A:
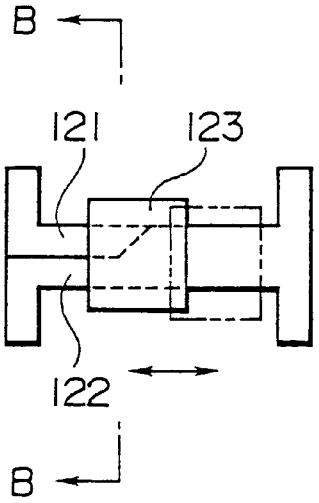
FIG. 11A and FIG. 11B are respectively an enlarged diagram and a cross section illustrating engaging pieces disposed on the lateral surfaces of the upper and the lower frame.
Figure 11B:
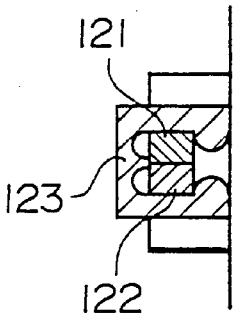
Figure 12:
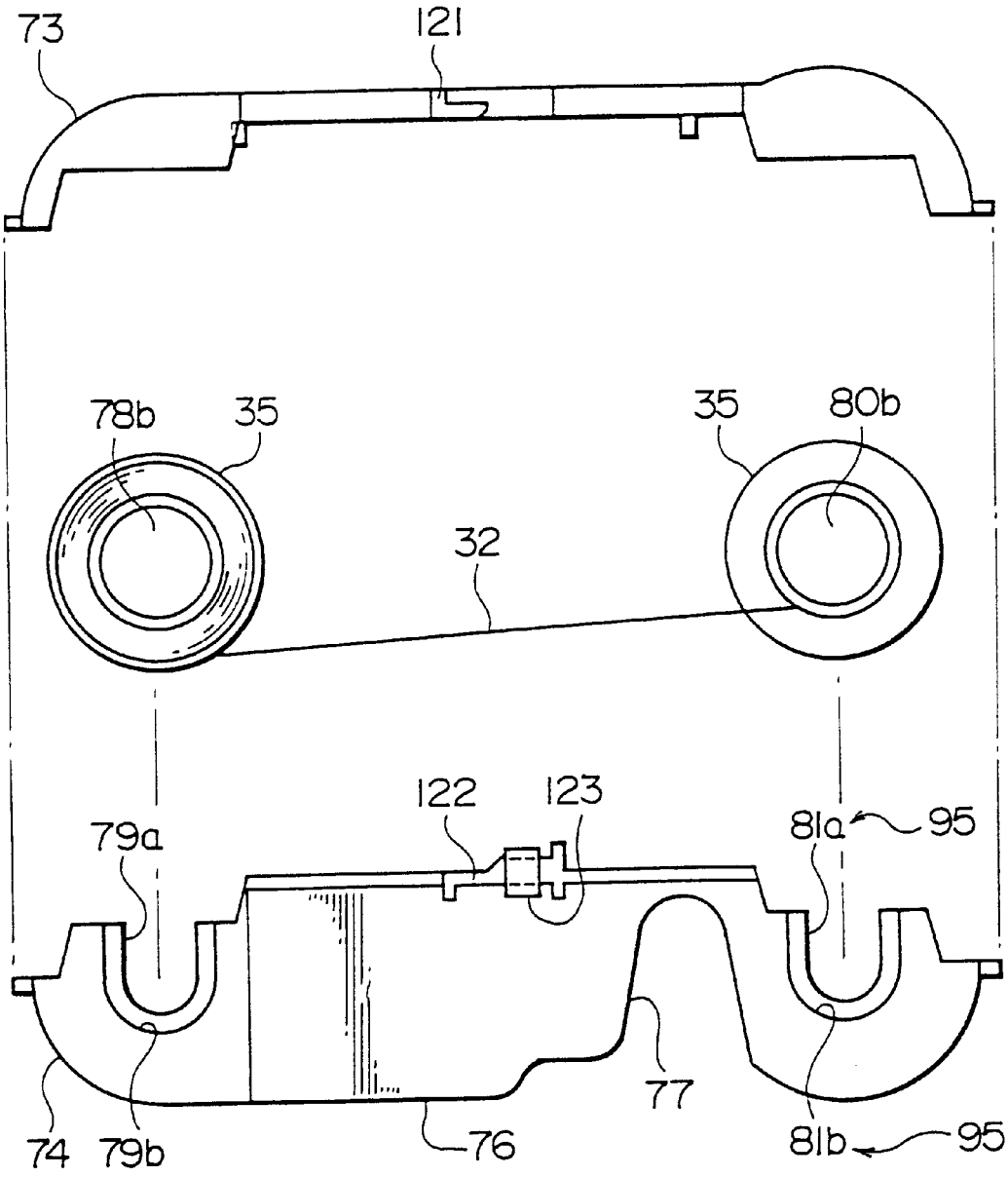
FIG. 12 is a side view illustrating the state in which the upper and the lower frame of the ink film cassette are separated from each other and an ink film is extracted from the ink film cassette.

In the cassette 33 of this embodiment, the upper and lower frames 73 and 74 are so formed as to be freely opened and closed, engaging pieces 121, 122 are formed in the lateral sides of the upper and lower frames 73 and 74 as illustrated in FIGS. 11A and 11B, and a slider 123 for linking and unlinking the two engaging pieces 121, 122 is disposed movably. The two engaging pieces are coupled and the upper and lower frames 73 and 74 are fastened to each other by abutting the two engaging pieces 121, 122 of the upper and lower frames 73 and 74 and thereafter moving the slider 123 to a position indicated by a solid line in FIG. 11A. By moving the slider 123 to a position indicated by a two-dot chain line, the two engaging pieces can be unlinked and the upper and lower frames 73 and 74 can be opened. The state in which the upper and lower frames 73 and 74 are opened is as illustrated in FIG. 12. The slider 123 remains on the lower frame 74 even when the upper and lower frames 73 and 74 are opened.

When the upper frame 73 and the lower frame 74 are provided in the abutting parts thereof with ribs, though omitted from illustration, the two frames 73 and 74 can be infallibly joined because they have their surfaces for contact increased. The ribs can be utilized as positioning members to the cassette 33 when the cassette 33 is loaded in the main body of the printer.

Particularly in the cassette 33 of this embodiment, the first torque limiter 85 for transmitting braking force to the supporting shaft 78*a* of the supply reel 30 in the cassette 33, is interposed detachably between the supporting shaft 78*a* of the supply reel 30 and the cassette 33.

Further, second braking means 95 for transmitting braking force to the supporting shafts 80*a* and 80*b* of the rewind reel 31 in the cassette 33 is interposed detachably between the supporting shafts 80*a* and 80*b* of the rewind reel 31.

The cassette 33 is further provided with the second torque limiter 97 for limiting the driving torque of the rewind reel 31 in the cassette 33.

Now, the first and second torque limiters 85 and 97 and the second braking means 95 will be described sequentially in the order mentioned.

Figure 13:
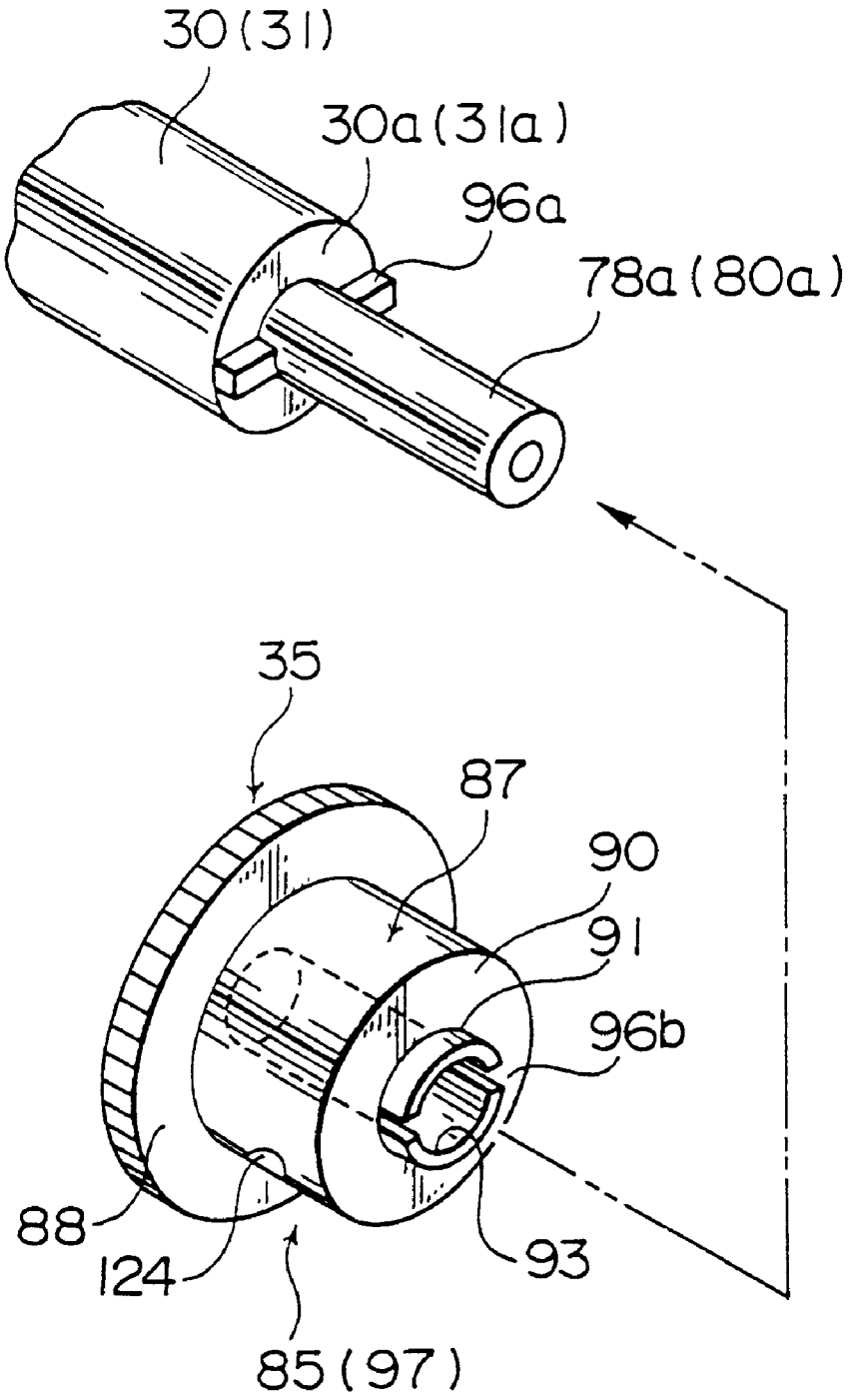
FIG. 13 is a perspective view illustrating one example of the set of a first torque limiter (first braking means) and a second torque limiter (torque limiting means).
Figure 14A:
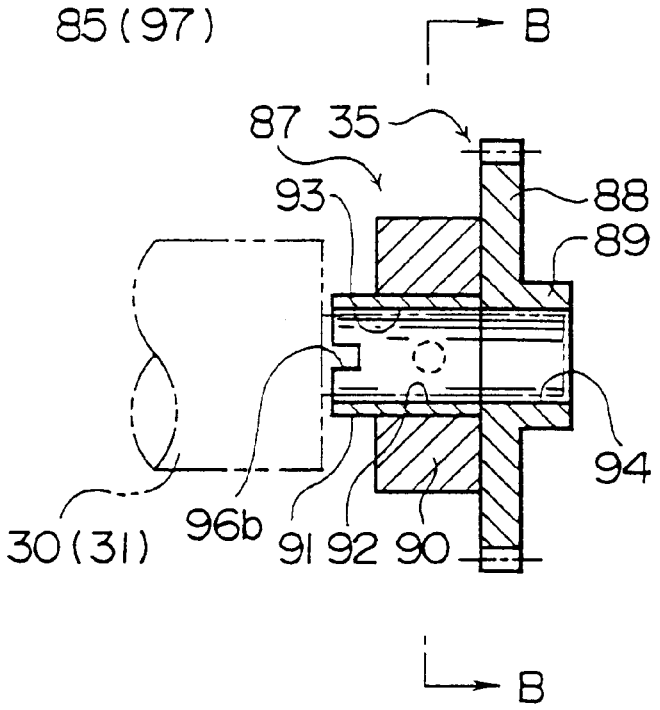
FIG. 14A and FIG. 14B are cross sections illustrating the first torque limiter and the second torque limiter respectively.

The first torque limiter 85, as illustrated in FIG. 13 and FIG. 14, is composed of a gear 35 and a limiter 87 attached to the gear 35. The gear 35 comprises a disc 88 having teeth formed on the outer peripheral surface and an axis 89 formed integrally with the disc 88. The limiter 87 comprises a housing 90 forming a main part and an inner shaft 91 retained detachably in a through hole 92 formed in the housing 90. The disc 88 of the gear 35 and the housing 90 of the limiter 87 are fixed to each other and are integrally rotatable. Through holes 93 and 94 for passing the supporting shaft 78*a* of the supply reel 30 are respectively formed in the inner shaft 91 and the gear 35. The shaft 78*a* is formed in a smaller diameter than the supply reel 30. A raised portion 96*a* extended in the direction of diameter is formed on the end surface 30*a* of the supply reel 30. A depressed portion 95*b* matched to the raised portion 96*a* is formed at the leading end of the inner shaft 91. When the raised portion 96*a* and the depressed portion 96*b* (hereinafter jointly referred to as an "engaging part") are engaged together, the supply reel 30 and the inner shaft 91 are jointly rotated.

Figure 14B:
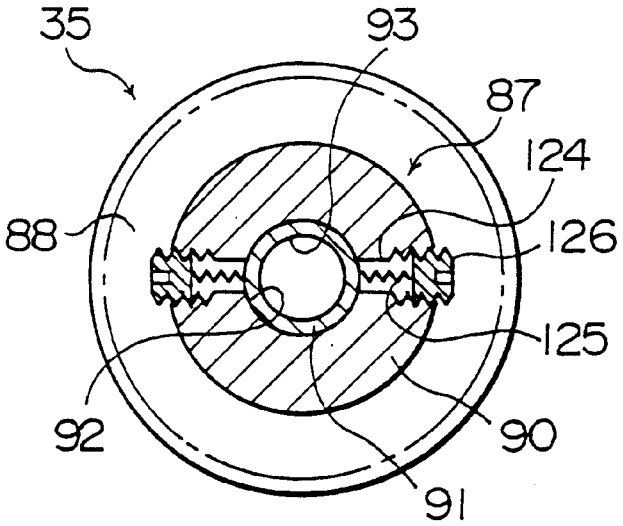

In the housing 90 of the limiter 87, two through hole 124 extended in the direction of diameter are formed in a piercing manner as illustrated in FIG. 14B. The through holes 124 have a spring 125 incorporated therein. A set screw 126 is pushed in an opening edge of the through hole 124. The two through holes 124 are formed at mutually confronting positions. The resilient force of the spring 125 acts on the inner shaft 91 from opposite radial directions.

The attachment of the first torque limiter 85 to the supply reel 30 is attained by inserting the first torque limiter 85 into the shaft 78*a* from the side of the inner shaft 91, positioning and meshing the raised portion 96*a* and the depressed portion 96*b*, and coupling the supply reel 30 and the inner shaft 91 through this engaging part. The first torque limiter 85 inserted into the shaft 78 is fixed in a state incapable of rotation relative to the cassette 33. When the first torque limiter 85 is in this state, the resilient force of the spring 125 acts on the inner shaft 91 from the opposite radial directions. And this resilient force also acts on the supply reel 30 which is connected to the first torque limiter 85 through the engaging parts 96*a*, 96*b*. As a result, the supply reel 30 is not rotated unless any torque overcoming the resilient force of the spring 125 acts on the supply reel 30. In short, the first torque limiter 85 confers a rotational load on the supply reel 30 by transmitting braking force to the supporting shaft 78*a* of the supply reel 30 inside the cassette 33.

The adjustment of the braking force of the first torque limiter 85 can be easily accomplished by adjusting the amount of insertion of set screws 126. In the case of a torque limiter of the type not provided with the set screws 126 and not enabled to adjust the braking force, the rotational load to be exerted on the supply reel 30 can be suitably altered by preparing a plurality of torque limiters each incorporating therein a spring for generating such resilient force as fits a prescribed braking force and selecting an adequate torque limiter from the plurality.

Figure 15:
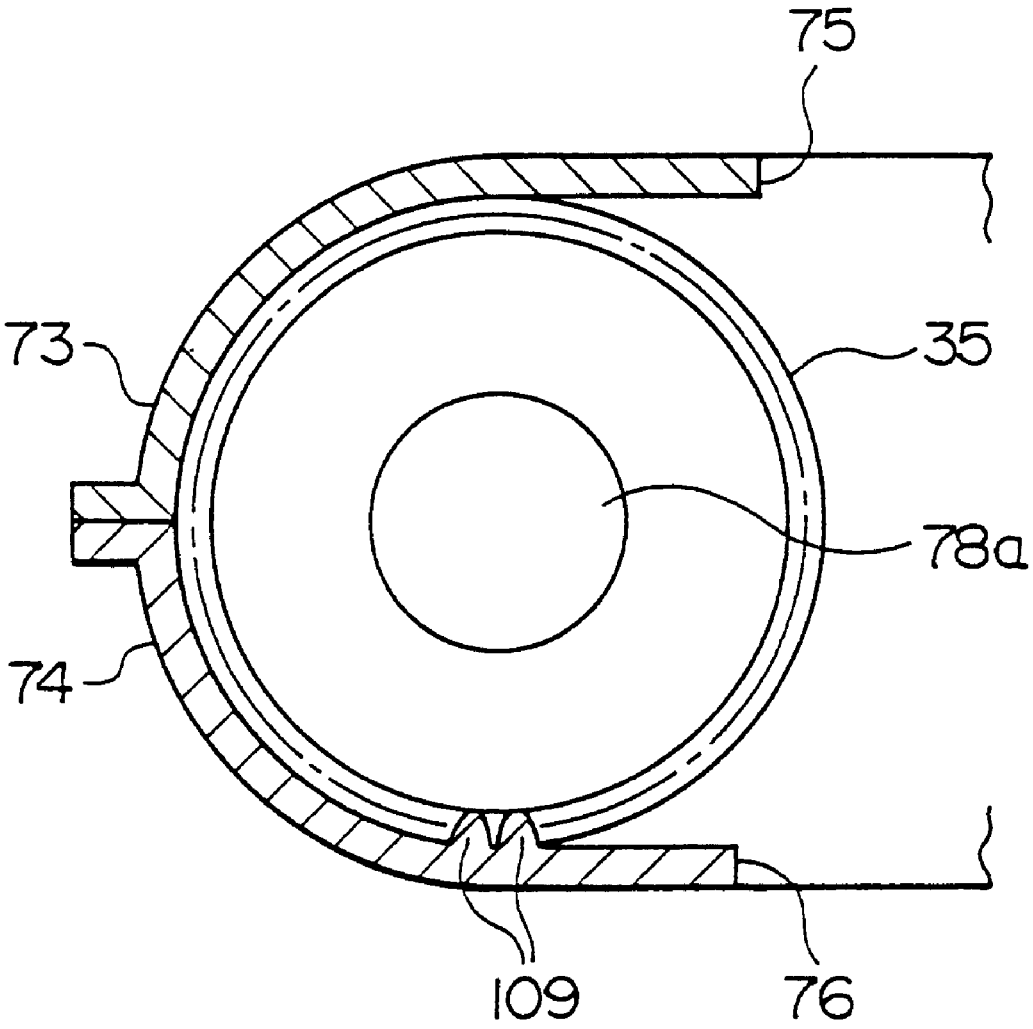
FIG. 15 is a cross section illustrating the construction in which the first torque limiter is fixed non-rotatably to the ink film cassette.

The first torque limiter 85 is retained fast on the frames 73 and 74 by causing the gear 35 to be nipped by the upper and lower frames 73 and 74. A simple disc-like member may be used in the place of the gear 35 when the first torque limiter 85 can be fixed non-rotatably relative to the cassette 33. Otherwise, it is possible to divert a gear 35 destined to form the second torque limiter 97 which will be specifically described herein below. Namely, this gear 35 may be prevented from rotating by meshing the gear 35 with knurls 109 which are shaped like gear teeth and formed on the inner surface of the cassette 33 as illustrated in FIG. 15. In this construction, the parts forming the torque limiters 85, 97 may be shared on the supply side and the take-up side, and the cost of components may be lowered.

Since the second torque limiter 97 is identical in construction with the first torque limiter 85 and, it will be omitted from the following detailed illustration and description. As indicated by the parenthesized reference numerals in FIG. 13, the shaft as the supporting shaft 80*a* of the rewind reel 31 is formed in a smaller diameter than the rewind reel 31 and the raised portion 96*a* is formed on the reel end face 31*a*. The rewind reel 31 and the inner shaft 91 are enabled to rotate in unison by meshing the raised portion 96*a* with the depressed portion 96*b* at the leading end of the inner shaft 91.

The gear 35 of the second torque limiter 97 is so disposed as to confront an opening 100 formed in the lower frame 74 (FIG. 9 and FIG. 10). When the cassette 33 is loaded into the main body of the printer as described above, this gear 35 is meshed with the drive gear 36 for rewinding an ink film through the opening 100.

The attachment of the second torque limiter 97 to the rewind reel 31 is attained by inserting the second torque limiter 97 into the shaft 80*a* from the side of the inner shaft 91 and coupling the rewind reel 31 and the inner shaft 91 through the engaging parts 96*a*, 96*b*. The second torque limiter 97 inserted into the shaft 80*a* is fixed in a state incapable of free rotation relative to the cassette 33. When the second torque limiter 97 is in this state, the resilient force of the spring 125 acts on the inner shaft from the opposite radial directions and this resilient force also acts on the rewind reel 31 which is connected to the second torque limiter 97 through the engaging parts 96*a*, 96*b*. As a result, the rotational force arising from the gear 35 is not transmitted to the rewind reel 31 and the gear 35 alone is idly rotated when any driving torque greater than the force equivalent to the resilient force of the spring 125 happens to act on the gear 35.

The adjustment of the driving torque by the second torque limiter 97 can be easily accomplished by adjusting the amount of insertion of set screws 126. In the case of a torque limiter of the type not provided with the set screws 126 and not enabled to adjust the driving torque, the driving torque of the rewind reel 31 can be limited to a suitable magnitude by preparing a plurality of torque limiters incorporated with a spring for generating such resilient force as fits a prescribed driving torque, and selecting an adequate torque limiter from the plurality.

Since the gear 35 and the limiter 87 are formed integrally with each other in advance, the first and second torque limiters 85 and 97 can be easily attached to the reels 30 and 31 by performing the work of insertion into the shafts 78*a* and 80*a* only once. Line operation or automated operation for the assembly of the ink film cassette can be easily designed because the assembly solely consists in the work of insertion. The removal of the reels 30 and 31 can be easily implemented by extracting them from the shafts 78*a* and 80*a*. The first and second torque limiters 85 and 97, therefore, can be readily attached to and detached from the shafts 78*a* and 80*a*.

Figure 16:
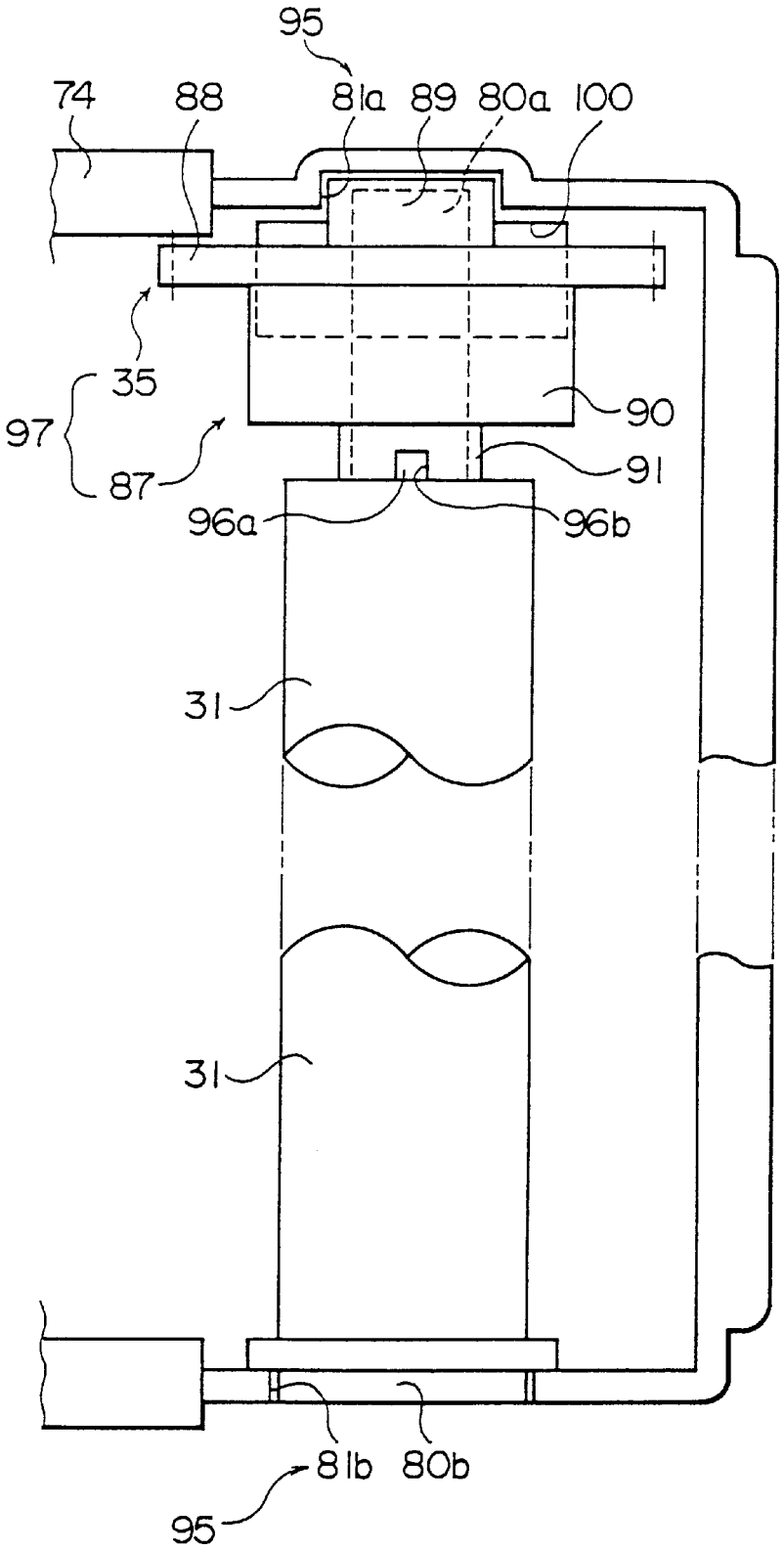
FIG. 16 is a plan view illustrating the vicinity of a take-up side bearing (second braking means) in a magnified state.

The second braking means 95 in the present embodiment, as illustrated on a magnified scale in FIG. 16, is composed of the take-up side bearings 81*b* supporting the shaft 80*b* of the rewind reel 31, and the take-up side bearing 81*a* supporting the gear shaft 89 inserted into the shaft 80*a*. The clearance between the take-up side bearing 81*b* and the shaft 80*b*, and the clearance between the take-up side bearing 81*a* and the gear shaft 89 are set at such sizes as permit transmission of braking force to the shaft 80*b* and the gear shaft 89 and consequent exertion of a rotational load on the rewind reel 31.

The supply side bearing 79*b* supporting the shaft 78*b* of the supply reel 30 and the supply side bearing 79*a* supporting the gear shaft 89 inserted into the shaft 78*a* are so formed as to reduce the slide resistance between the shaft 78*b* and the gear shaft 89 to the fullest possible extent.

Since the second braking means 95 transmits the rotational load to the rewind reel 31 as described above, the torque of the second torque limiter 97 on the take-up side is set in consideration of the rotational load on the rewind reel 31. Specifically, the torque of the first torque limiter 85 on the supply side is greater than that of the second torque limiter 97.

The materials used for the various components of the torque limiters 85 and 97 are the same, and the set screws 126 used in the limiters are differentiated solely in the amount of insertion. Owing to this setup, the difference in torque between the supply side and the take-up side can be easily retained because the two torque limiters 85 and 97 manifest the same behavior even when the service temperature of the cassette 33 happens to vary. The components on the supply side and those on the take-up side may be made of different materials, however, on the condition that the variation of the difference in torque due to a variation of the service temperature can be confined within an allowable range.

The possible confusion between the first torque limiter 85 and the second torque limiter 97 during their attachment to the reels 30 and 31 can be precluded by such means as forming the former limiter 85 in a black color and the latter limiter 97 in a white color, for example. Alternatively, it is allowable to preclude the confusion between the torque limiters 85 and 97 on the supply side and the take-up side during their attachment positively by differentiating in shape the gear shafts 89 of the torque limiters 85 and 97 and accordingly differentiating in shape the bearings 79*a* and 81*a* on the supply side and the take-up side.

Since the cassette 33 in the present embodiment has the first and second torque limiters 85 and 97 provided in the ink film cassette, the printer 10 using this cassette 33 does not require the supply side torque limiter and the take-up side torque limiter to be installed within the main body of the printer. The elimination of the torque limiter on the main body of the printer serves the purpose of simplifying the construction of the main body of the printer and lowering the cost of the printer proper.

Further, the first and second torque limiters 85 and 97 which are installed in the cassette 33 do not require as high durability as the other components in the main body of the printer. They only require to possess such durability as enables them to function normally until the ink film 32 held in the ink film cassette is used up, namely until it has formed, for example, 100 printed images as a plane. As a result, the first and second torque limiters 85 and 97 can be formed relatively inexpensively as compared with the conventional torque limiters. Owing to the consequent reduction in the cost of components, the cost of the whole printer can be further decreased.

Since the cassette 33 is provided therein with the first torque limiter for transmitting braking force to the supporting shaft 78*a* of the supply reel 30, there is no possibility that during the distribution of the ink film cassette as a consumable product, the ink film 32 will slack and immediately run out of the supply reel 30 under the influence of an external force. Therefore, the unused ink film 32 will not be wasted. By the same token, there is no possibility that the unused ink film 32 will immediately run out of the supply reel 30 under the influence of an external force and the unused ink film 32 will be consequently wasted when the cassette 33 happens to be removed from the printer 10 before the ink film 32 has been completely used up.

Further, since the rotational load is exerted also on the rewind reel 31 in the cassette 33 by the second braking means 95 composed of the take-up side bearings 81*a* and 81*b*, there is no possibility that the used ink film 32 will immediately run out of the rewind reel 31 under the influence of an external force and the ink film 32 will be consequently damaged as when the cassette 33 happens to be removed from the thermal transfer printer before the ink film 32 has been completely used up.

Since the first torque limiter 85 and the take-up side bearings 81*a* and 81*b* disposed in the cassette 33 fulfill concurrently the function of a stopper for preventing the supply reel 30 and the rewind reel 31 from rotating as during the transportation of the cassette 33, the cassette 33 has neither any particular need for being specially provided with a stopper mechanism for exclusive use, nor any possibility of being complicated in construction, nor exclusive work for prevention of the run-out such as fixing the stopper to the supporting shaft.

The torque of the first torque limiter 85 on the supply side is set at a greater than that of the second torque limiter 97 on the take-up side. When the rewind reel 31 is set rotating, therefore, the ink film 32 in a slacked state is taken up on the rewind reel 31 and caused to assume a taut state. When the rewind reel 31 is subsequently rotated further, there is no possibility of the ink film 32 being drawn out of the supply reel 30 because the driving torque acting on the gear 35 surpasses the resilient force of the spring 125 and the gear 35 alone may make an idle rotation.

Since the torque of the first torque limiter 85 is set at a greater than that of the second torque limiter 97, the unused ink film 32 is not drawn out of the supply reel 30, but the used ink film 32 is drawn out of the rewind reel 31 when the thermal head 26 is lowered and pressed against the platen roller 25 in preparation for the printing operation. Thus, the unused ink film 32 will not be wastefully used. Since the ink areas of varying colors can be narrowed as a consequence, it is made possible to increase the number of ink areas that can be applied to the ink film 32 of a fixed length and add to the number of images that can be formed.

Further, the work for attaching the first and second torque limiters 85 and 97 during the manufacture of the cassette 33 is facilitated because the attachment of these torque limiters 85 and 97 to the reels 30 and 31 is accomplished simply by inserting the torque limiters 85 and 97 into the shafts 78*a* and 80*a*. The work for placing the rewind reel 31 in the cassette 33 is also facilitated because the second braking means 95 comprises the take-up side bearings 81*a* and 81*b* and, thus requires no particular component for exclusive use.

Figure 17A:
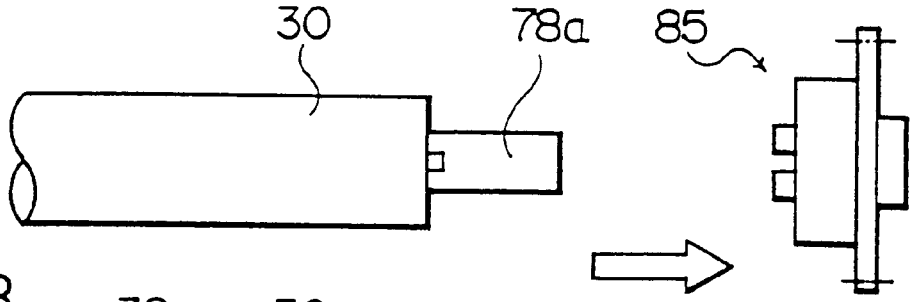
FIG. 17A and FIG. 17B are conceptual diagrams illustrating the procedure of attachment of the torque limiter to a new reel.
Figure 17B:
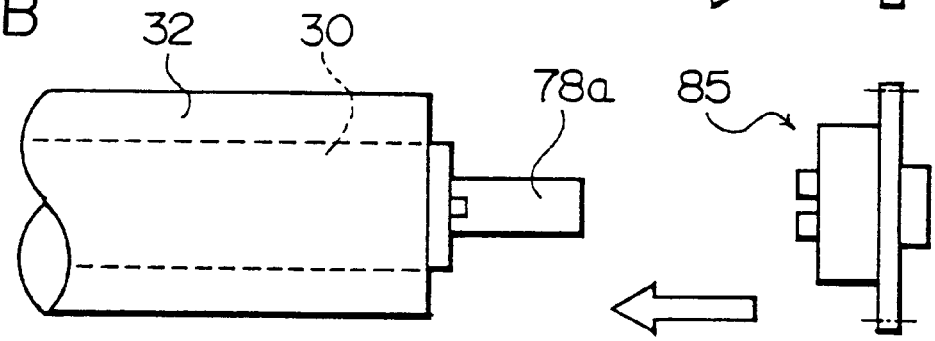

The torque limiters 85 and 97 can be incorporated into and extracted from the cassette 33 in conjunction with the reels 30 and 31 and, moreover, can be easily attached to and detached from the shafts 78*a* and 80*a*. Thus, as illustrated in FIG. 17A, the first torque limiter 85 can be removed from the supply reel 30 which has been used up. As illustrated in FIG. 17B, this first torque limiter 85 can be attached to a new supply reel 30 and readily incorporated in the cassette 33. The second torque limiter 97 can be attached, though not illustrated in the diagram, to a new rewind reel 31 and readily incorporated in the cassette 33 in the same manner. The user, therefore, can perform all by himself the work of refilling the ink film 32 alone. While the cassette 33 is indeed a consumable product, the torque limiters 85 and 97 can be recovered for reuse and the components as wastes can be decreased to the fullest possible extent.

Further, on the side of the cassette 33, the torque of the torque limiters 85 and 97 can be altered by adjusting the set screws 126, or the alteration of torque itself can be attained by adopting other torque limiters in the place of the torque limiters 85 and 97 currently set in the ink film cassette. The fact that the torque can be altered on the side of the cassette 33 means that the torque can be altered on the side of the cassette 33 depending on the kind of the ink film 32 to be used. It is, therefore, made possible to enrich the variety of kinds of films to be effectively used in one thermal transfer printer. An ink film which obviates, or substantially obviates, the necessity for transmitting braking force to the supply reel 30 such as an ink film having a backcoat with a large friction coefficient may be applied to the ink film cassette.

The alteration of the torque is not easily attained when the torque limiters are formed integrally with the ink film cassette. If the alteration is effected at all, the ink film cassette must be provided with a mechanism which is capable of varying the length of the spring in the torque limiter. Inevitably, the mechanism brings about an increase in the cost of the ink film cassette. In contrast, in the case of the torque limiters 85 and 97 which are formed integrally with the reels 30 and 31 as in the ink film cassette of the present embodiment, the work of alteration is simple and has no possibility of increasing the cost of the cassette 33 because the torque limiters 85 and 97 can be extracted from the cassette 33 in conjunction with the reels 30 and 31 and they may be replaced with new torque limiters having different torque. Even when the torque limiters 85 and 97 are provided with a mechanism such as the set screws 126 which are capable of varying the lengths of the springs 125 in the torque limiters 85 and 97, the work of alteration can be readily carried out because the torque limiters 85 and 97 can be extracted from the cassette 33.

(Operation of thermal transfer printer)

Now, the operation of the illustrated thermal transfer printer 10 will be described below with reference to FIGS. 4A–4C and FIGS. 5A, 5B.

(Paper feeding [FIG. 4A])

When the control device (not shown) outputs an instruction to print under the condition that the printer is in the initial state, namely the state in which the recording papers 18 and the ink film cassette 33 are set in place, the paper feeding motor M4 sets the paper feed roller 45 rotating to advance only one of the recording papers 18 through a minute gap between the paper feed roller 45 and the riffle roller 46.

The recording paper 18 is advanced in the direction indicated by the arrow mark B by the rotation of the paper feed roller 45. Then, the paper feeding motor M4 is stopped when the trailing end sensor S1 detects the leading end of the recording paper 18. At this time, the leading end of the recording paper 18 is nipped between the grip roller 50 and the pinch roller 51. Subsequently, the grip roller driving motor M5 sets the grip roller 50 rotating to advance the recording paper 18 further and, when the trailing end sensor S1 detects the trailing end of the recording paper 18, the grip roller driving motor M5 is brought to a stop. The forward conveyance of the recording paper 18 is effected while the thermal head 26 is separated from the platen roller 25. The rocking guide 58 which has been swung to the upper position guides the recording paper 18 into the holding space 56.

While the paper feeding is carried out, the motor M2 and the rewinding motor M3 are set rotating and the rewinding roller 37 draws the ink film 32 out of the supply reel 30 and rewinds the ink film 32 on the rewind reel 31 to remove slack from the ink film 32, and position the leading end of the ink film 32. The motor M2 and the rewinding motor M3 are stopped when the mark sensor S3 detects the positioning mark arranged on the ink film 32.

(Start of printing [FIG. 4B])

The thermal head driving motor M1 rotates the eccentric cam 29 and presses the thermal head 26 against the platen roller 25. Then, the grip roller driving motor M5 rotates the grip roller 50 and effects return conveyance of the recording paper 18 in the direction indicated by the arrow mark C. The printing is started immediately after the trailing end sensor S1 detects the trailing end of the recording paper 18 and a yellow image is formed on the recording paper 18. The system the return conveyance of the recording paper during the printing operation is merely composed of the grip roller 50.

Figure 4C:
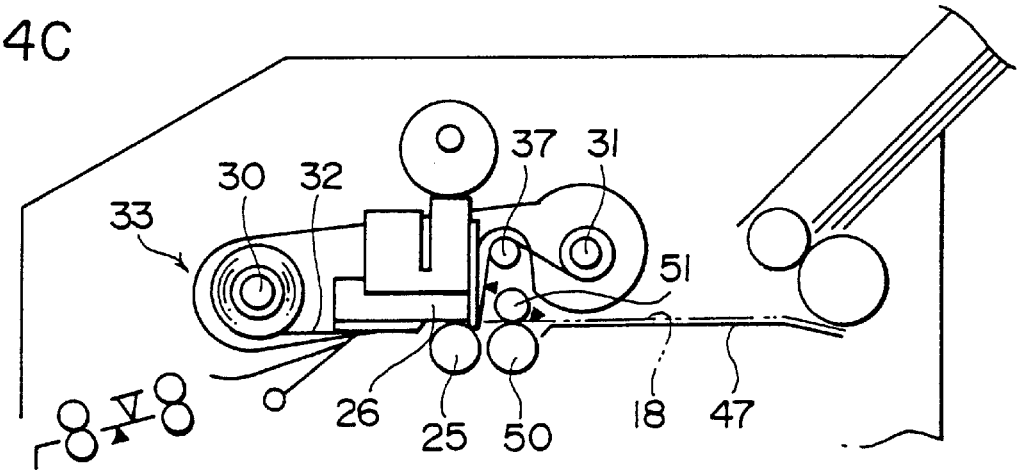

(Completion of printing [FIG. 4C])

When the printing is continued until the leading end of the recording paper, the possibility ensues that the ink will be transferred onto the platen roller 25. Thus, the printing is stopped and the return conveyance of the recording paper 18 is also stopped while the recording paper 18 remains between the platen roller 25 and the ink film 32. The thermal head driving motor M1 sets the eccentric cam 29 rotating to detach the thermal head 26 from the platen roller 25.

For the printing in the next color, or when the printing of overcoat is necessary, the recording paper 18 is conveyed forward by the grip roller 50 and guided to the holding space 56 as illustrated in FIG. 4B. The forward conveyance to the position for starting the printing is attained by transmitting a rotation equivalent to a prescribed number of pulses to the grip roller driving motor M5.

Simultaneously with the preparation for the printing in the next color, the motor M2 and the rewinding motor M3 are set rotating and the encoder disposed at one end of the rewinding roller 31 measures the amount of conveyance of the ink film 32 by counting the pulses and meanwhile effects the leading end positioning of the next ink layer. Then, the printing operation is executed in the same manner to produce a print in the next color. This procedure is repeated severally for all the colors involved. Otherwise, an overcoat is printed.

(Cutting of leading end [FIG. 5A])

When the printing in all the colors or the overcoat printing is completed, the thermal head 26 is detached to break contact with the platen roller 25 and the rocking guide 58 is swung to the lower position. The recording paper 18 which is conveyed forward by the grip roller 50 is guided in the direction of the paper discharging unit 22. The conveying motor M6 is rotated in a prescribed timing and the second paired discharge rollers 54 convey the recording paper 18 forward. When the leading end sensor S2 detects the leading end of the recording paper 18, the grip roller driving motor M5 and the conveying motor M6 are stopped.

Then, the conveying motor M6 is rotated over an angular distance equal to a prescribed number of pulses corresponding to a prescribed length from the leading end of the recording paper and the second paired discharge rollers 54 advances the recording paper 18 in the direction of the cutter unit 23. When the conveyance of the recording paper 18 is stopped, the rotary cutter 60 and the cradle 61 cooperate to cut off the leading end of the recording paper 18 in a prescribed length from the leading end. The scraps of paper which arise from the cutting are allowed to fall under their own weights into the duster 24 to be ultimately recovered.

Figure 5B:
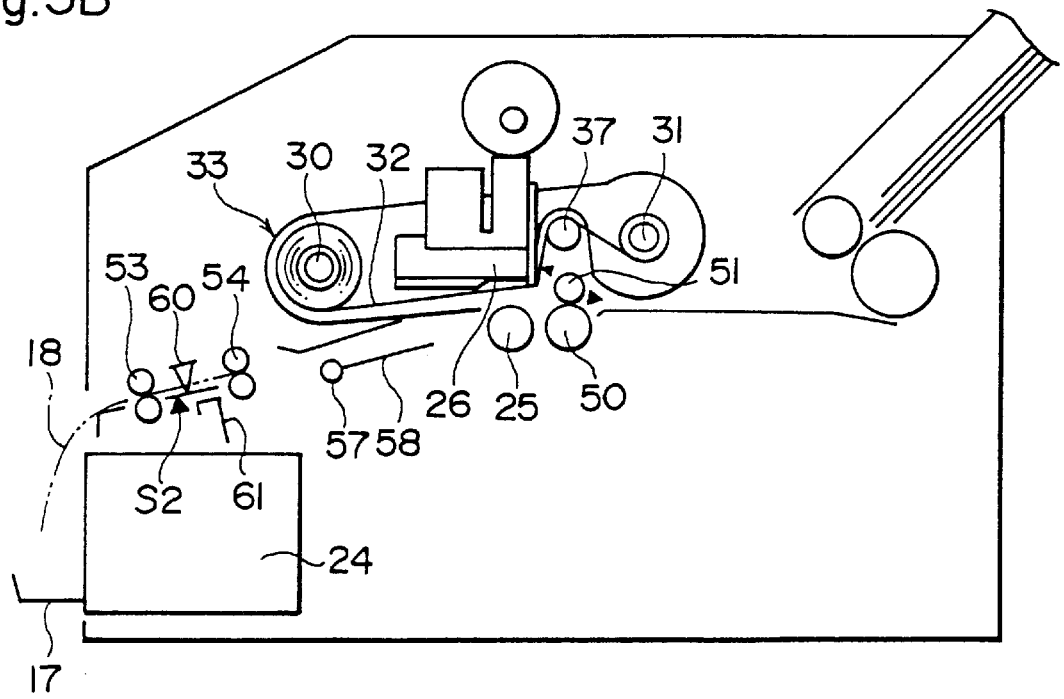

(Cutting of trailing end [FIG. 5B])

When the cutting of the leading end is completed, the conveying motor M6 is rotated over an angular distance equal to the number of pulses corresponding to a prescribed length, and the first paired discharge rollers 53 and the second paired discharge rollers 54 are driven to convey the recording paper 18. Then, the rotary cutter 60 is actuated to cut off the trailing end of the recording paper 18 in a prescribed length from the trailing end.

At the time that the cutting of the trailing end is completed, the recording paper 18 destined to become a finished product having a color image reproduced thereon is nipped by the first paired discharge rollers 53, and the unwanted part of the paper which has been cut off remains to be nipped by the second paired discharge rollers 54. Then, the conveying motor M6 is rotated reversely over an angular distance equal to a prescribed number of pulses to effect reverse rotation of the second paired discharge rollers 54 and cause the unwanted parts of paper to be returned in the direction of the printing unit 20. As a result, the unwanted parts of paper are separated from the second paired discharge rollers 54 and dropped into the duster 24 for the recovery. Even when the conveying motor M6 happens to be rotated reversely, the first paired discharge rollers 53 are prevented from rotating reversely by the action of the one-way clutch and the recording paper 18 is continuously nipped by the first paired discharge rollers 53. Even when the conveying motor M6 is rotating reversely, the user can extract the recording paper from the first paired discharge rollers 53.

When the recovery of the unwanted parts of paper is completed, the conveying motor M6 is normally rotated over an angular distance equal to a prescribed number of pulses and the recording paper 18 is conveyed by the first paired discharge rollers 53 and discharged onto the paper discharge tray 17.

Second Embodiment

The first torque limiter 85, the second torque limiter 97, and the second braking means 95 do not need to be limited to the above-mentioned constructions but may be variously modified on the condition that they are readily attached to and detached from the supporting shafts 78*a* and 80*a* of the reels 30 and 31.

The first torque limiter 85, for example, may be formed by detachably fitting to the inner surface of the ink film cassette 33 an elastic member such as a sponge which makes sliding contact with the periphery of the shaft 78*a* of the supply reel 30 and transmits a rotational load on the supply reel 30. The transmission of a rotational load to the rewind reel 31 may be accomplished by allowing the supporting shaft 80*a* of the rewind reel 31 to protrude from the second torque limiter 97 and enabling the take-up side bearing 81*a* as the second braking means 95 to provide direct support for the shaft 80*a*. The elastic member such as a sponge which makes sliding contact with the peripheral surface of the gear shaft 89 or the shaft 80*a* on the take-up side, may be detachably attached to the inner surface of the cassette 33 and enabled to transmit a rotational load on the rewind reel 31.

Third Embodiment

Figure 18:
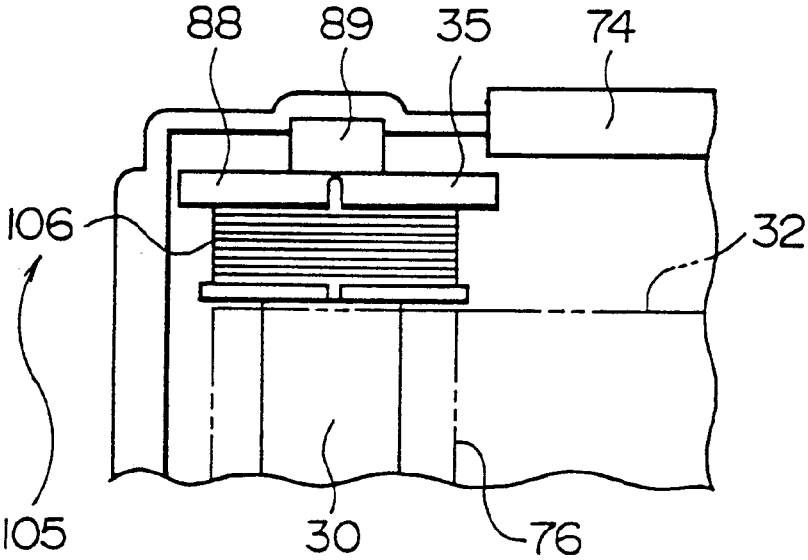
FIG. 18 is a transverse sectional view illustrating the essential part of an ink film cassette according to another embodiment of this invention.

FIG. 18 is a cross section illustrating the essential part of an ink film cassette according to another embodiment of this invention. Besides the construction of the ink film cassette 33 of the first embodiment, the cassette 33 of the present embodiment comprises rewinding means 105 for causing the ink film 32 paid out of the supply reel 30 to be rewound on the supply reel 30, which is detachably attached to the supply reel 30 in the cassette 33.

The rewinding means 105 gives the rotating force to the supply reel 30 in the direction of rewinding the unwound part of the ink film 32. It is formed of a kick spring 106 as in the illustrated embodiment. In the first torque limiter 85 of the present embodiment, the main part 90 of the limiter 87 is not fixed relative to the disc-like part 88 of the gear 35 and is rotatable relative to the gear 35 under the non-rotatable state. One end of the kick spring 106 is fastened to the gear 35 and the other end thereof to the main part 90 of the first torque limiter 85. When the ink film 32 is paid out of the supply reel 30, the kick spring 106 is caused to accumulate resilient force. When the ink film 32 ceases to run out, the supply reel 30 is rotated by the resilient force in the direction of having the ink film rewound thereon.

In the thermal transfer printer 10, when the printing in one color is completed and the recording paper 18 is advanced in preparation for the printing in the next color, the forced contact of the thermal head 26 with the platen roller 25 is broken provisionally. Since the ink film 32 continues to remain in a slacked state at this time, the ink film 32 is generally taken up on the rewind reel 31 to a certain extent for the sake of removing the slack. Since the present embodiment has the kick spring 106 provided for the supply reel 30, the slacked part of the ink film 32 is forcibly rewound on the supply reel 30 and the ink film 32 is retained in a taut state. When the thermal head 26 is pressed against or separated from the platen roller 25, the start point of printing on the ink film 32 are not easily deviated and the ink areas of the ink film 32 can be economically used. Since the various color ink areas can be consequently narrowed, the number of ink areas effectively applicable to the ink film 32 of a fixed length can be increased and the number of printed images can be also increased.

When the supply reel 30 is provided with the kick spring 106 and further the rewind reel 31 is retained under a greater rotational load than the force of the kick spring, a high load is exerted on the rewind reel 31. In such a case the energy accumulated in the kick spring 106 will not be wholly consumed when the ink film 32 is rewound on the supply reel 30. As a result, under the condition that the cassette 33 has been extracted from the printer 10, the ink film 32 is not slacked and can be retained or conserved in a taut state because of the force generated by the kick spring 106 provided in the supply reel 30 and the rotational load exerted on the rewind reel 31.

Typical Modifications of Torque Limiter

Figure 23:
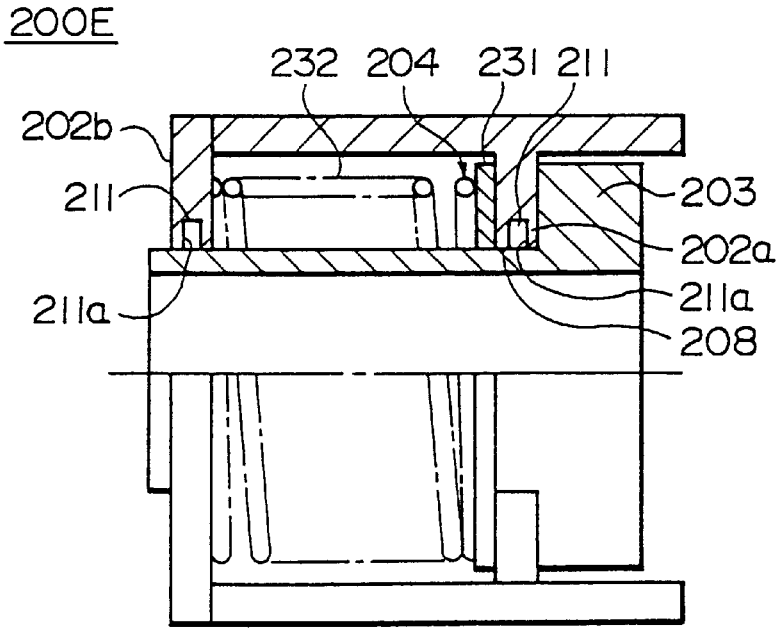
FIG. 23 is a cross section illustrating a fifth modification of the torque limiter.
Figure 24:
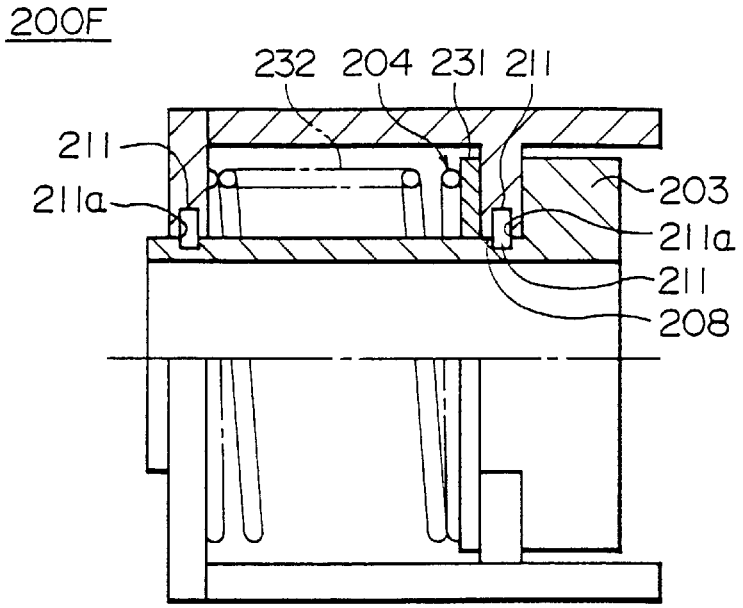
FIG. 24 is a cross section illustrating a sixth modification of the torque limiter.
Figure 25:
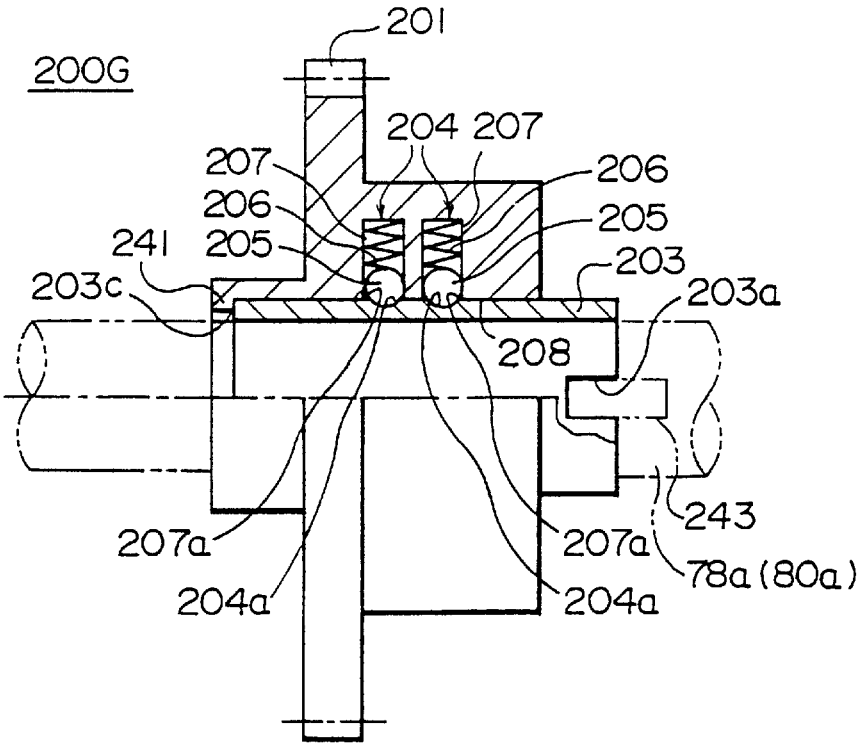
FIG. 25 is a cross section illustrating a seventh modification of the torque limiter.
Figure 26:
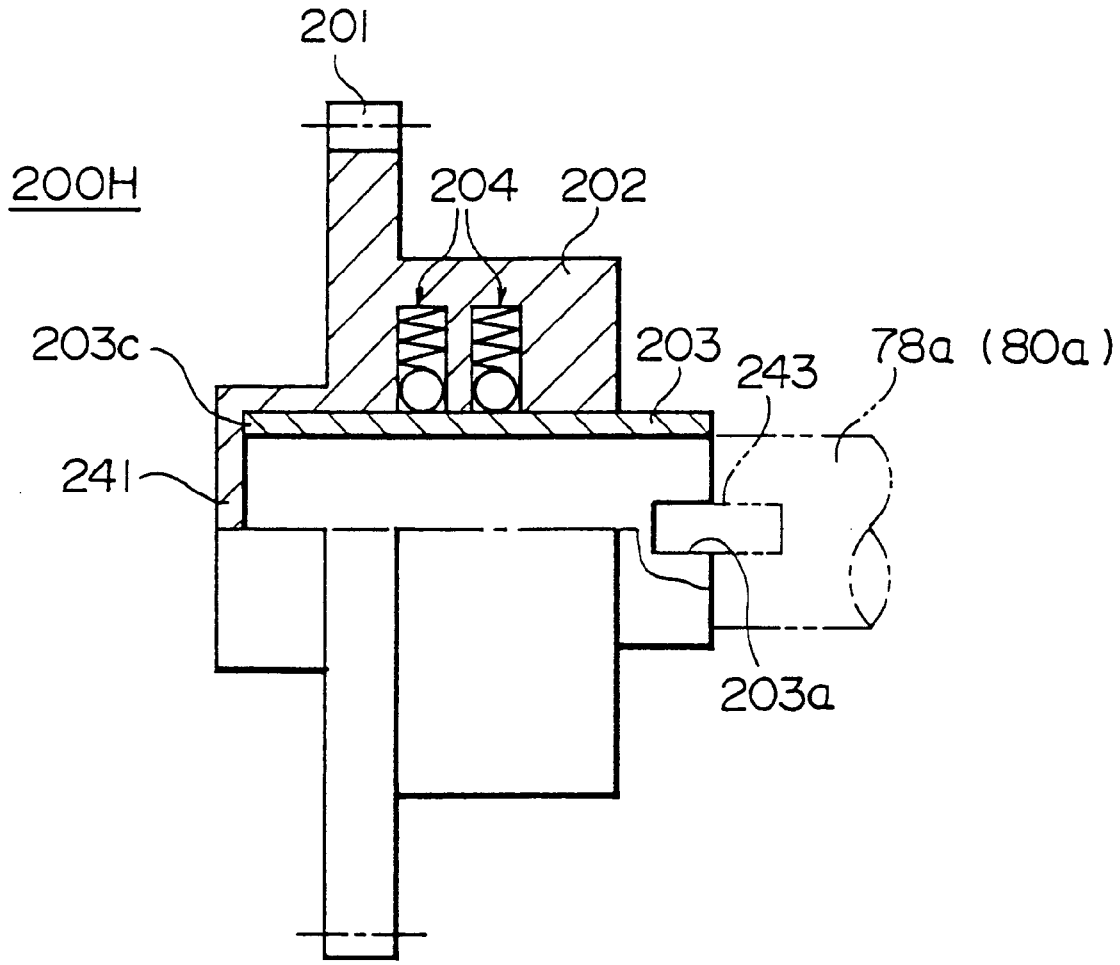
FIG. 26 is a cross section illustrating a eighth modification of the torque limiter.

As the torque limiters 85 and 97 in the above mentioned embodiments, torque limiters 200A–200H illustrated in FIG. 19–FIG. 26 can be also used. These torque limiters 200A–200H are severally provided with a housing 202, an inner shaft 203 rotatably supported in the housing 202, and pressing means 204 arranged in the housing 202 and pressed against the inner shaft 203 to exert a rotational load on the inner shaft 203. The shafts 78*a* and 80*a* of the reels 30 and 31 are put in place on the inner shaft 203 and the inner shafts 203 are consequently rotated in conjunction with the reels 30 and 31. The torque limiters 200A–200F illustrated in FIG. 19–FIG. 24 are severally provided with grease 209 applied between the inner shaft 203 and the pressing means 204, and a grease receiver 211 disposed on the inner shaft 203 and/or in the housing 202 in such a manner that an opening 211*a* thereof confronts a boundary 208 between the inner shaft 203 and the housing 202. The torque limiters 200G and 200H illustrated in FIG. 25 and FIG. 26 are severally provided with a stopper 241 disposed in the housing 202 to arrest the leading end of the inner shaft 203 in the axial direction.

(First modification)

Figure 19:
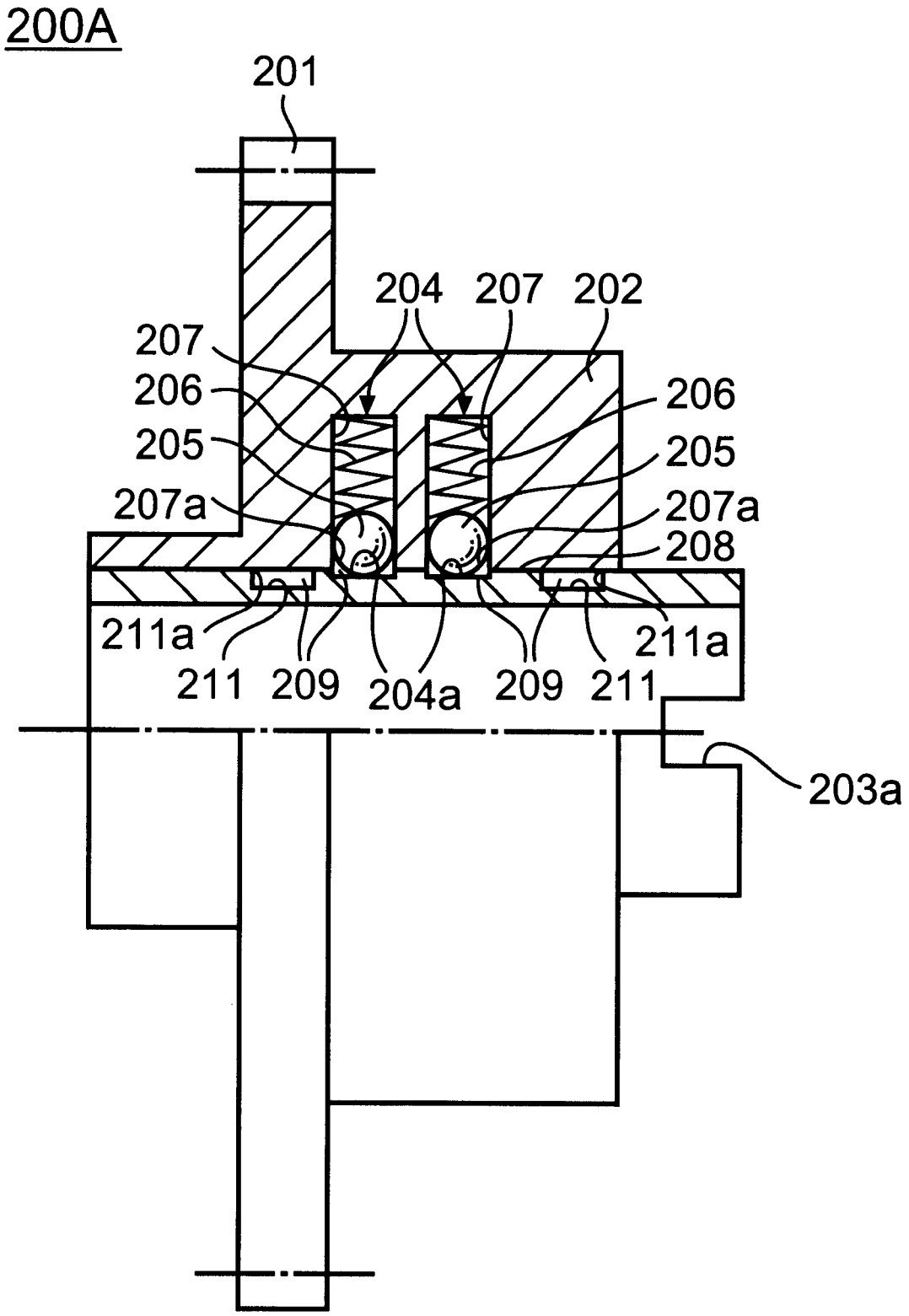
FIG. 19 is a cross section illustrating a first modification of the torque limiter.

To be specific, the torque limiter 200A illustrated in FIG. 19 may acquire a set torque by supporting the inner shaft 203 rotatably in the housing 202 with a gear 201, and exerting a rotational load on the inner shaft 203 by means of the pressing means 204 disposed in the housing 202. The pressing means 204 is so constructed that metallic balls 205 such as steel balls may be pressed, by springs 206, against annular grooves 204*a* formed on the periphery of the inner shaft 203. The springs 206 and the metallic balls 205 are received and retained in holes 207 formed in the shell of the housing 202. The metallic balls 205 are thrust out through openings 207*a* confronting a boundary 208 in the holes 207 between housing 202 and the inner shaft 203, and is pressed against the annular grooves 204*a*. Two sets of pressing means 204 are disposed in the illustrated embodiment. The number of pressing means 204 may be suitably altered, depending on such factors as the set torque. Pressing means of various other constructions are also usable. The inner shaft 203 is provided at the base with a coupling part 203*a* which engages with the raised portions 96*a* (FIG. 13) of the reels 30 and 31. The grease 209 is coated between the metallic balls 205 and the annular grooves 204*a* of the pressing means 204. The grease 209 fills the role of stabilizing the friction force generated between the pressing means 204 and the inner shaft 203 and preventing heat generation. In consequence of the increase in the total number of rotations of the torque limiter 200A, the grease 209 tends to leak through the boundary 208. For the solution of these disadvantages, the torque limiter 200A is provided on the outer peripheral surface of the inner shaft 203 with the grease receiver 211 which is implemented with an opening 211*a* confronting the boundary 208.

Since the grease receiver 211 disposed on the inner shaft 203 is provided with the opening 211*a* which confronts the midway portion of the boundary 208 forming a path for the leakage of the grease 209, it offers an outlet for the grease 209 tending to leak through the boundary 208 and accumulates it therein. There is, therefore, no possibility of the grease 209 getting over the grease receiver 211 and leaking to the exterior. There is no possibility of smearing the ink film and staining the user's hand during the work of refilling of the ink film. Further, the grease receiver 211 is capable of dispensing the grease 209 stored therein when the supply of the grease 209 between the inner shaft 203 and the pressing means 204 verges on shortage. Consequently, it can be precluded that the shortage of the grease 209 results in occurrence of an excessive load. And the torque limiter 200A is enabled to response exactly to the present torque.

This embodiment contemplates using the grease designated by Worked Consistency No. 2 of NLG1 (National Lubricating Grease Institute) (having a worked consistency in the range of 265–295), though not exclusively.

(Second Modification)

Figure 20:
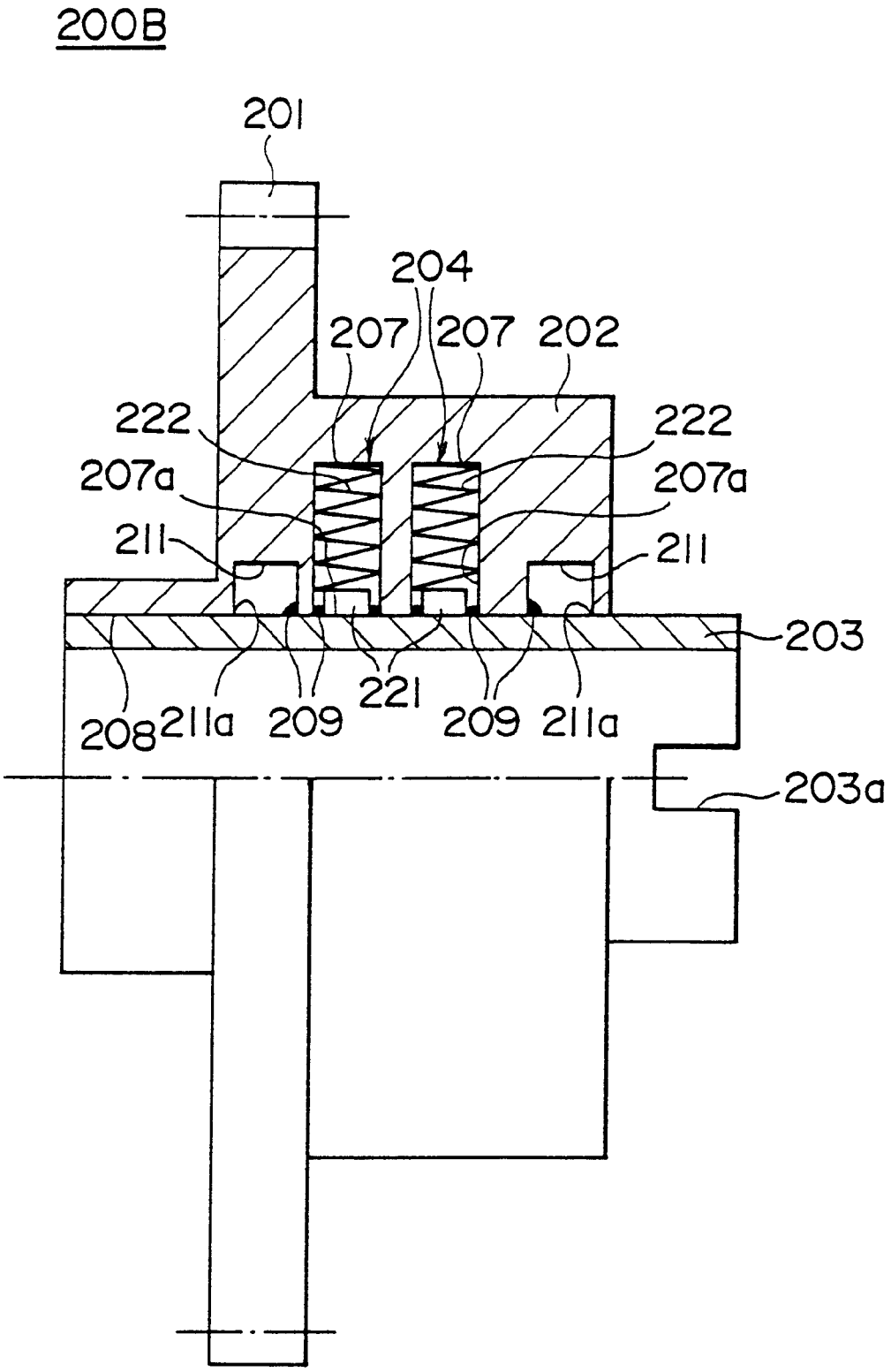
FIG. 20 is a cross section illustrating a second modification of the torque limiter.

The torque limiter 200B illustrated in FIG. 20 has the grease receiver 211 formed on the inner peripheral surface of the housing 202. It is provided, similarly to the first modification, with an opening 211*a* which confronts the boundary 208 between the housing 202 and the inner shaft 203. The grease receiver 211, therefore, manifests the same action and effect as that of the first modification. The pressing means 204 in this second embodiment is enabled to acquire a set torque by the fact that a metallic pad 221 such as of steel is pressed by a spring 222 against the cylindrical peripheral surface of the inner shaft 203 to exert a rotational load on the inner shaft 203. Since the second modification is identical in the other aspect of construction and in the action and effect with the first modification, like components will be denoted by like reference numerals and will be omitted from the following detailed description to avoid repetition.

(Third Modification)

Figure 21A:
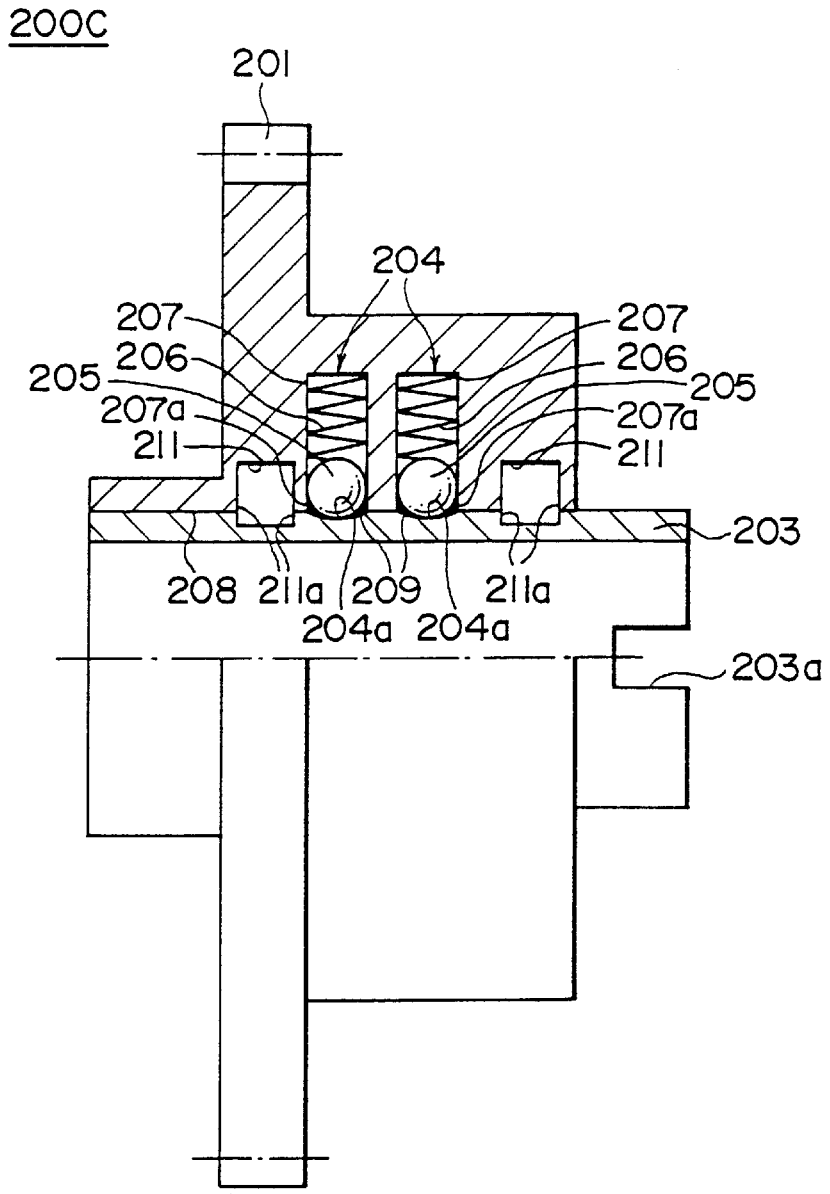
FIG. 21A and FIG. 21B are cross sections illustrating a third modification of the torque limiter.

The torque limiter 200C illustrated in FIG. 21A adopts the same pressing means 204 as that of the first modification. It has grease receivers 211 formed one each on the outer peripheral surface of the inner shaft 203 as in the first modification and on the inner peripheral surface of the housing 202 as in the second modification.

Figure 21B:
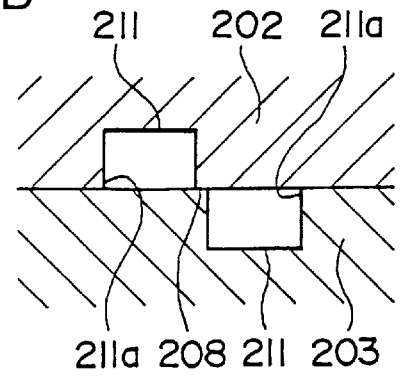

The provision of the grease receivers 211 one on the side of the inner shaft 203 and the other on the side of the housing 202 proves advantageous where the total volume of the grease receiver 211 is augmented and the amount of the sealed or stored grease 209 is increased. It is naturally permissible to have the grease receiver 211 on the side of the inner shaft 203 and the grease receiver 211 on the side of the housing 202 disposed at mutually different positions along the axial direction as illustrated in FIG. 21B. Since the third modification is identical in the other aspect of construction and in the action and effect with the first and the second modification, like components will be denoted by like reference numerals and will be omitted from the following detailed description to avoid repetition.

(Fourth Modification)

Figure 22:
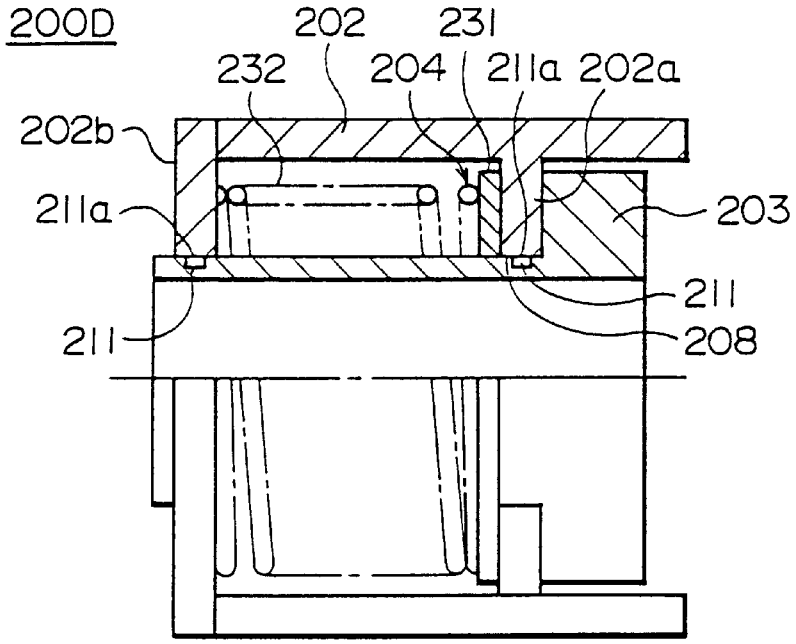
FIG. 22 is a cross section illustrating a fourth modification of the torque limiter.

The torque limiter 200D illustrated in FIG. 22 causes the rotational load generated by the pressing means 204 to act on the inner shaft 203 along the axial direction. The housing 202 is provided on one terminal side with an end wall 202*a* and on the other terminal side with an end wall 202*b*. The inner shaft 203 is provided with a metallic pad 231 which rotates integrally with the inner shaft 203 and, at the same time, confronts the end wall 202*a*. A compression vane 232 is interposed between the metallic pad 231 and the end wall 202*b*. This embodiment is enabled to obtain the set torque by the fact that the metallic pad 231 is pressed against the end wall 202*a* of the housing 202 and the rotational load is exerted on the inner shaft 203. The grease receiver 211 of the fourth modification is formed on the outer peripheral surface of the inner shaft 203 similarly to that of the first modification and manifests the same action and effect as that of the first modification.

(Fifth Modification)

The torque limiter 200E illustrated in FIG. 23 adopts the same pressing means 204 as that of the fourth modification. It has the grease receiver 211 formed on the inner peripheral surface of the housing 202 similarly to that of the second modification and manifests the same action and effect as that of the second modification. Since the fifth modification is identical in the other aspect of construction and in the action and effect with the fourth modification, like components will be denoted by like reference numerals and will be omitted from the following detailed description to avoid repetition.

(Sixth Modification)

The torque limiter 200F illustrated in FIG. 24 adopts the grease receiver 211 formed on the outer peripheral surface of the inner shaft 203 similarly to that of the fourth modification and the grease receiver 211 formed on the inner peripheral surface of the housing 202 similarly to that of the fifth modification and manifests the same action and effect as that of the third modification. Since the sixth modification is identical in the other aspect of construction and in the action and effect with the fourth and fifth modifications, like components will be denoted by like reference numerals and will be omitted from the following detailed description to avoid repetition.

(Seventh Modification)

The torque limiter 200G illustrated in FIG. 25 is provided with the same housing 202, inner shaft 203, and pressing means 204 as those used in the first through third modifications. The housing 202, however, is provided with a stopper 241 which arrests a leading end 203*c* of the inner shaft 203 opposite to the coupling part 203*a* in the axial direction. In this construction, a depressing force surpassing the rotational load by the pressing means 204 on the inner shaft 203 happens to act on the inner shaft 203 from the side of the coupling part 203*a*. Therefore, even when the inner shaft 203 is depressed toward the side of the leading end 203*c*, the inner shaft 203 is prevented from advancing further. Because the leading end 203*c* collides against the stopper 241 and remains fast. Even when the set torque is small, there is no possibility of the inner shaft 203 being depressed excessively, extracted accidentally, and rendered unserviceable.

Further in the seventh modification, the inner shaft 203 is in the shape of a hollow tube and the stopper 241 of the housing 202 is a flange smaller than the inside diameter of the inner shaft 203. This torque limiter 200G, therefore, can be used in a state such that the shafts 78*a* and 80*a* coupled with the inner shaft 203 may penetrate the inner shaft 203 as indicated by an imaginary line in FIG. 25. The reels 30, 31 are coupled with the inner shaft 203 and can rotate as one by the fact that a key 243 which is put in place on the shafts 78*a* and 80*a* of the reels 30, 31 is meshed with the coupling part 203*a* of the inner shaft 203. This modification does not need to be limited to this construction, but may adopt various coupling constructions known in the art.

(Eighth Modification)

The torque limiter 200H illustrated in FIG. 26 differs from the seventh modification in respect that the stopper 241 of the housing 202 forms an end wall capable of occluding a leading end 203*c* of the inner shaft 203. This stopper 241 is further capable of arresting the leading ends of the shafts 78*a* and 80*a*. Since this modification is identical in the other aspect of construction and in the action and effect with the seventh modification, like components will be denoted by like reference numerals and will he omitted from the following detailed description to avoid repetition.

Incidentally, the seventh and eighth modifications, when provided with the same grease receiver 211 as that of the first through third modifications, are capable of effective use.

What is claimed is:

1. An ink film cassette attached detachably to a thermal transfer recording device comprising:

a supply reel having an ink film wound thereon;

a rewind reel for taking up said ink film fed out of said supply reel;

a frame for receiving said supply reel and said rewind reel; and braking means detachably held between said supply reel and said frame for applying friction torque to said supply reel;

wherein said braking means includes a housing, said housing being detachably held between said supply reel and said frame, said housing having an opening for receiving a shaft of said supply reel.

2. An ink film cassette according to claim 1, which further comprises second braking means disposed detachably between said rewind reel and said frame for applying friction torque to said rewind reel.

3. An ink film cassette according to claim 1, which further comprises torque limiting means detachably attached in said rewind reel for transmitting to said rewind reel driving force generated by a driving section provided in said thermal transfer recording device and thereby limiting driving torque of said rewind reel.

4. An ink film cassette according to claim 3, wherein said braking means and said torque limiting means both are made of a same material.

5. An ink film cassette according to claim 1, wherein said frame is formed of an upper frame and a lower frame which are divisible in a vertical direction, and said braking means is fixed as nipped between said upper and lower frames.

6. An ink film cassette according to claim 1, wherein said braking means is capable of adjusting friction torque.

7. The ink film cassette according to claim 1, wherein a clearance between said shaft and said housing applies friction torque to said shaft.

8. The ink film cassette according to claim 1, wherein said housing includes an area that receives a spring, said spring for applying said friction torque to said shaft.

9. The ink film cassette according to claim 8, wherein said braking means includes a device for adjusting an amount of friction torque applied by said spring to said shaft.

10. The ink film cassette according to claim 8, wherein said spring is oriented to apply said friction torque to a cylindrical exterior surface of said shaft.

11. The ink film cassette according to claim 8, wherein said spring is oriented to apply said friction torque to a planar surface of said shaft.

12. An ink film cassette attached detachably to a thermal transfer recording device comprising:

a supply reel having an ink film wound thereon;

a rewind reel for taking up said ink film fed out of said supply reel;

a frame for receiving said supply reel and said rewind reel; and braking means detachably held between said rewind reel and said frame for applying friction torque to said rewind reel;

wherein said braking means includes a housing, said housing being detachably held between said rewind reel and said frame, said housing having an opening for receiving a shaft of said rewind reel.

13. The ink film cassette according to claim 12, wherein a clearance between said shaft and said housing applies friction torque to said shaft.

14. The ink film cassette according to claim 12, wherein said housing includes an area that receives a spring, said spring for applying said friction torque to said shaft.

15. The ink film cassette according to claim 14, wherein said braking means includes a device for adjusting an amount of friction torque applied by said spring to said shaft.

16. The ink film cassette according to claim 14, wherein said spring is oriented to apply said friction torque to a cylindrical exterior surface of said shaft.

17. The ink film cassette according to claim 14, wherein said spring is oriented to apply said friction torque to a planar surface of said shaft.

18. An ink film cassette attached detachably to a thermal transfer recording device comprising:

a supply reel having an ink film wound thereon;

a rewind reel for taking up said ink film fed out of said supply reel;

a frame for receiving said supply reel and said rewind reel; and braking means detachably held between said rewind reel and said frame for applying friction torque to said rewind reel;

wherein said braking means includes bearings rotatably supporting said rewind reel.

19. An ink film cassette for use in a thermal transfer recording device comprising:

a housing;

a supply reel having a shaft having an ink film wound thereon; and a torque limiter held between said housing and said shaft for preventing said shaft from freely rotating while said supply reel is in use;

wherein said torque limiter includes a body, said body being detachably held between said housing and said shaft, said body having an opening for receiving said shaft of said supply reel.

20. An ink film cassette according to claim 19, wherein said shaft is provided with a grease receiving groove so disposed as to have an opening of said groove confront said torque limiter.

21. An ink film cassette according to claim 19, wherein said torque limiter is provided on a surface of said torque limiter located opposite said shaft with a grease receiving groove so disposed as to have an opening of said groove confront said shaft.

22. The ink film cassette according to claim 19, wherein a clearance between said shaft and said body applies friction torque to said shaft.

23. The ink film cassette according to claim 19, wherein said body includes an area that receives a spring, said spring for applying friction torque to said shaft.

24. The ink film cassette according to claim 23, wherein said torque limiter includes a device for adjusting an amount of friction torque applied by said spring to said shaft.

25. The ink film cassette according to claim 23, wherein said spring is oriented to apply said friction torque to a cylindrical exterior surface of said shaft.

26. The ink film cassette according to claim 23, wherein said spring is oriented to apply said friction torque to a planar surface of said shaft.

27. An ink film cassette for use in a thermal transfer recording device comprising:

a housing;

a rewind reel having a shaft for taking up an ink film; and a torque limiter held between said housing and said shaft for transmitting to said shaft driving force generated by a driving section provided in said thermal transfer recording device and limiting driving torque of said shaft;

wherein said torque limiter includes a body, said body being detachably held between said housing and said shaft, said body having an opening for receiving said shaft of said rewind reel.

28. An ink film cassette according to claim 27, wherein said shaft is provided with a grease receiving groove so disposed as to have an opening of said groove confront said torque limiter.

29. An ink film cassette according to claim 27, wherein said torque limiter is provided on a surface of said torque limiter located opposite said shaft with a grease receiving groove so disposed as to have an opening of said groove confront said shaft.

30. The ink film cassette according to claim 27, wherein a clearance between said shaft and said body applies friction torque to said shaft.

31. The ink film cassette according to claim 27, wherein said body includes an area that receives a spring, said spring for applying friction torque to said shaft.

32. The ink film cassette according to claim 31, wherein said torque limiter includes a device for adjusting an amount of friction torque applied by said spring to said shaft.

33. The ink film cassette according to claim 31, wherein said spring is oriented to apply said friction torque to a cylindrical exterior surface of said shaft.

34. The ink film cassette according to claim 31, wherein said spring is oriented to apply said friction torque to a planar surface of said shaft.

35. A reel for winding an ink film therearound and for use in a thermal transfer recording device having an ink film cassette which is detachably attached to a body of the thermal recording device, said reel comprising:

a shaft for winding the ink film therearound in the ink film cassette;

a portion for detachably coupling with a torque limiter in a rotational axis direction;

a protrude for transmitting a rotational movement of the shaft to the torque limiter when the reel couples with the torque limiter;

wherein said torque limiter is detachably held between a housing of the ink film cassette and the reel in the ink film cassette for preventing the reel from freely rotating; and wherein said torque limiter includes a housing having an opening for receiving said shaft, said housing including an area that receives a spring, said spring for applying a friction torque to said shaft.

36. A torque limiter for use in a thermal transfer recording device having an ink film cassette which is detachably attached to a body of the thermal recording device, said torque limiter comprising:

a first portion for engaging with a housing of the ink film cassette;

a second portion for engaging with a reel of the ink film cassette which winds an ink film therearound;

wherein said torque limiter is detachably held between the housing and the reel in the ink film cassette for preventing the reel from freely rotating while said torque limiter is in use; and a body having an opening for receiving a shaft of said reel, said body including an area that receives a spring, said spring for applying a friction torque to said shaft.

* * * * *